US005736293A

United States Patent [19]

Hirai et al.

[11] Patent Number: 5,736,293

[45] Date of Patent: Apr. 7, 1998

[54] IMAGE FORMING METHOD

[75] Inventors: Hiroyuki Hirai; Michio Ono; Takashi Nakamura, all of Kanagawa, Japan

[73] Assignee: Fuji Photo Film Co., Ltd., Kanagawa, Japan

[21] Appl. No.: 736,205

[22] Filed: Oct. 25, 1996

[30] Foreign Application Priority Data

Oct. 26, 1995 [JP] Japan ..... 7-279210

[51] Int. Cl.[6] ..... G03C 8/40; G03C 8/06; G03C 5/30

[52] U.S. Cl. ..... 430/203; 430/206; 430/249; 430/404; 430/481; 430/353

[58] Field of Search ..... 430/203, 206, 430/249, 404, 481, 353

[56] References Cited

U.S. PATENT DOCUMENTS

| | | | |
|---|---|---|---|
| 3,146,104 | 8/1964 | Yackel et al. | 430/264 |
| 3,355,007 | 11/1967 | De Haes | 430/249 |
| 4,165,237 | 8/1979 | Shiba et al. | 430/227 |
| 4,242,436 | 12/1980 | Mertens et al. | 430/249 |
| 4,876,171 | 10/1989 | Hirai | 430/203 |
| 4,888,267 | 12/1989 | De Rycke | 430/206 |
| 5,009,984 | 4/1991 | De Rycke et al. | 430/206 |
| 5,677,104 | 10/1997 | Hirai et al. | 430/203 |

FOREIGN PATENT DOCUMENTS

| | | | |
|---|---|---|---|
| 546598 | 6/1993 | European Pat. Off. . | |
| 62-283332 | 12/1987 | Japan | G03C 5/54 |

*Primary Examiner*—Rivhard L. Schilling

*Attorney, Agent, or Firm*—Sughrue, Mion, Zinn, Macpeak & Seas, PLLC

[57] ABSTRACT

An image forming method comprising the steps of:

(a) superposing a heat development photosensitive material on a sheet after or simultaneously with imagewise exposing the heat development photosensitive material, wherein the photosensitive material comprises a support having thereon at least a photosensitive silver halide, a hydrophilic binder and a slightly water-soluble basic metal compound, and the sheet comprises a support having thereon at least a compound which forms a complex with the metal ion constituting the basic metal compound, a solvent for a silver halide and a physical development nucleus; and (b) heat developing the laminate in the presence of a reducing agent and water to form an image on either or both of the photosensitive material and the sheet, wherein the reducing agent comprises a 1-phenyl-3-pyrazolidone compound and a dihydroxybenzene compound having an inorganic value of not less than 215 and an organic value of from 120 to 400.

3 Claims, No Drawings

IMAGE FORMING METHOD

FIELD OF THE INVENTION

The present invention relates to an image forming method using a silver halide photosensitive material. In particular, the invention relates to an image forming method using a heat development photosensitive material, whereby a black-and-white image high in density and low in fog can be obtained for a short period of time.

BACKGROUND OF THE INVENTION

Photographic methods using silver halides are excellent in photographic characteristics such as sensitivity, gradation control and resolving power, as compared with other photographic methods such as electrophotographic methods and diazo photographic methods, and therefore have previously been most widely used.

At present, image information is largely shifted from black-and-white images to color images because of a great deal of information and easy expressions. However, black-and-white images are still preferably used in specific fields, for example, in the medical field. Further, in print field, plate-making materials for color images are also used as black-and-white images for every printing ink. Thus, there have still been large demands for the black-and-white images, centering around industrial applications.

In recent years, systems in which images can be obtained easily and rapidly have been developed by shifting image formation processing of photosensitive materials using silver halides from conventional wet processing to instant systems containing developing solutions and further to dry heat development processing by heating, etc., from viewpoints including environmental protection. Such heat development photosensitive materials are described in *Shashin Kohgaku no Kiso* (*Higinen Shashin*) (The Fundamentals of Photographic Engineering (Nonsilver Photograph)), pages 242 to 255 (1982), Corona Publishing Co. Ltd., JP-B-43-4921 (the term "JP-B" as used herein means an "examined Japanese patent publication") and JP-B-43-4924.

For example, as the products of the black-and-white series, "Dry Silver" photosensitive materials supplied from Minnesota Mining and Manufacturing Co. are put on the market.

For monosheet photosensitive materials comprising silver halides, organic bases and reducing agents, such as Dry Silver, unused silver halides and organic silver salts remain in heat-developed images. The photosensitive materials are therefore disadvantageous in that when they are exposed to strong light or stored for a long period of time, the residual silver halides and organic silver salts are printed out to cause coloration of white grounds, resulting in loss of contrast.

Further, a method for obtaining black color images by dry processing is described in *Research Disclosure* (hereinafter abbreviated as "RD"), No. 17326, pages 49 to 51 (September, 1978). However, this system also has the same disadvantage as described above because of the nonfixing type containing silver salts in color images.

In order to overcome this disadvantage, methods for forming black-and-white images are described in JP-B-3-78617 and JP-B-3-45820 in which, after movable (diffusible) dyes are imagewise formed or released by heating, the movable dyes are transferred to dye fixing materials containing dye accepting materials such as mordants and heat-resistant organic polymers by use of various transfer solvents, thereby improving keeping quality.

However, in these methods, transfer is conducted after heat development, so that the number of steps is increased and the processing time is prolonged.

Further, JP-A-3-260645 (the term "JP-A" as used herein means an "unexamined published Japanese patent application") discloses heat development transfer type black-and-white image forming methods utilizing a coupling reaction, which include a method of conducting transfer after development and a method of conducting development and transfer simultaneously. However, these methods also require a long period of time and a high temperature for the processing because of the absence of a development transfer accelerator.

Furthermore, JP-A-62-1219848 discloses that black-and-white images can be formed from transferred dye images which are formed by heat development using a small amount of water. However, in order to obtain images having a transmission density of 2 or more, which are required for many black-and-white images, by dye transfer methods for a short period of time, it is necessary to reduce the film thickness of the photosensitive materials, particularly required to make the amount of binders as small as possible and to increase the amount of dye donating compounds used. This presents the problems of an impaired quality of the films and increased cost. Further, this introduces the problem that the use thereof is limited because of a reduction in sharpness caused by transfer. Furthermore, it is difficult to synthesize black dye donating compounds, and it is also difficult to obtain neutral gray color images by mixing yellow, magenta and cyan dye donating compounds.

Moreover, methods for forming silver images using silver halide photosensitive materials by heat development silver salt diffusion transfer are disclosed in JP-A-62-283332, JP-A-63-198050 and JP-A-60-194448. However, these methods also utilize transferred silver images. It is therefore difficult to obtain images having a transmission density of 2 or more, high in sharpness and low in fog for a short period of time, and improvements have been required. In addition, for the photosensitive materials for plate-making, it is desirable that the gradation is as hard as possible. However, the above-mentioned image forming methods are insufficient for satisfying the desire, and an improvement has also been required in this respect.

SUMMARY OF THE INVENTION

It is therefore an object of the present invention to provide an image forming method which provides, for a short period of time, a silver image high in density and low in fog.

Another object of the present invention is to provide an image forming method which provides an excellent halftone image with high contrast.

The above-described objects of the present invention has been achieved by the following constitutions (1) to (4):

(1) An image forming method comprising the steps of:

(a) superposing a heat development photosensitive material on a sheet after or simultaneously with imagewise exposing the heat development photosensitive material, wherein the photosensitive material comprises a support having thereon at least a photosensitive silver halide, a hydrophilic binder and a slightly water-soluble basic metal compound, and the sheet comprises a support having thereon at least a compound which forms a complex with the metal ion constituting the basic metal compound, a solvent for a silver halide and a physical development nucleus; and (b) heat developing the laminate in the presence of a reducing agent and water to form an image on either or both of the photosensitive material and the sheet, wherein the reducing agent comprises a 1-phenyl-3-pyrazolidone compound and a dihydroxybenzene compound having an inorganic value of not less than 215 and an organic value of from 120 to 400;

(2) The image forming method as described in the above (1), wherein the molar ratio of the 1-phenyl-3-pyrazolidone compound to the dihydroxybenzene compound is from 95:5 to 50:50;

(3) The image forming method as described in the above (1) or (2), wherein the dihydroxybenzene compound is a catechol compound; and (4) The image forming method as described in the above (1), (2) or (3), wherein the sheet further comprises a mordant, and an image is formed on the photosensitive material.

By using the specified reducing agents as described above, a reduction in development time, suitable development of an exposed silver halide and rapid transfer of a silver halide placed on an unexposed area to the sheet take place. Accordingly, a silver image having a high density is obtained for a short period of time. Moreover, an excellent halftone image is obtained with high contrast.

DETAILED DESCRIPTION OF THE INVENTION

The present invention is described in detail below.

Examples of the 1-phenyl-3-pyrazolidone compound for use in the present invention as a reducing agent include a group of compounds represented by formula (I):

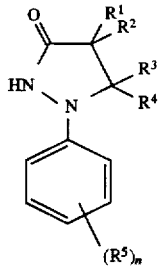

(I)

In general formula (I), $R^1$ to $R^4$ each represents a hydrogen atom or a substituent.

Examples of the substituent represented by $R^1$ to $R^4$ include alkyl groups having from 1 to 60 carbon atoms (e.g., methyl, ethyl, propyl, iso-butyl, t-butyl, 2-ethylhexyl, nonyl, undecyl, pentadecyl and n-hexadecyl), aryl groups having from 1 to 30 carbon atoms (e.g., phenyl, naphthyl, p-methoxyphenyl, etc.), acylamino groups having from 2 to 60 carbon atoms (e.g., acetylamino, n-butanoylamino, octanoylamino, 2-hexadecanoylamino, 2-(2', 4'-di-t-amylphenoxy)butanoylamino, benzoylamino and nicotinoylamino), alkoxyl groups having from 1 to 60 carbon atoms (e.g., methoxy, ethoxy, butoxy, n-octyloxy, hexadecyloxy and 2-methoxyethoxy), aryloxy groups having from 6 to 60 carbon atoms (e.g., phenoxy, 2,4-t-amylphenoxy, 4-t-butylphenoxy and naphthoxy), alkylthio groups having from 1 to 60 carbon atoms (e.g., methylthio, ethylthio, butylthio and hexadecylthio), arylthio groups having from 6 to 60 carbon atoms (e.g., phenylthio and 4-dodecyloxyphenylthio), acyl groups having from 1 to 60 carbon atoms (e.g., acetyl, benzoyl, butanoyl and dodecanoyl), sulfonyl groups having from 1 to 60 carbon atoms (e.g., methanesulfonyl, butanesulfonyl and toluenesulfonyl), sulfonylamino groups having from 1 to 60 carbon atoms (e.g., methanesulfonylamino and phenylsulfonylamino), cyano groups, carbamoyl groups having from 1 to 60 carbon atoms (e.g., N,N-dicyclohexylcarbamoyl), sulfamoyl groups having from 0 to 60 carbon atoms (e.g., N,N-dimethylsulfamoyl), sulfo groups (including salts thereof), carboxyl groups (including salts thereof), halogen atoms (e.g., chlorine, bromine and fluorine) and a hydroxyl group.

These substituents may be further substituted by these substituents, and may bond each other to form a ring if possible.

Examples of the substituent represented by $R^5$ include the substituents exemplified for $R^1$ to $R^4$, and n represents an integer of 0 to 5. When n is 2 or more, a plurality of $R^5$ may be the same or different.

Preferred substituent represented by $R^1$ to $R^4$ include a hydrogen atom, alkyl groups or aryl groups. The alkyl group is more preferably a methyl or hydroxymethyl group, and the aryl group is more preferably a phenyl group.

Preferred substituent represented by $R^5$ include a hydrogen atom, a halogen atom (e.g., chlorine and bromine), an alkyl group (an alkyl group having 1 to 10 carbon atoms, e.g., methyl, ethyl, t-butyl and 2-ethylhexyl) or an alkoxyl group (an alkoxyl group having 1 to 10 carbon atoms, e.g., methoxy, iso-propoxy and 2-ethylhexyloxy).

n is preferably 0 or 1.

The preferred structure of the dihydroxybenzene compound having an inorganic value of 215 or more and an organic value of from 120 to 400, which is used as a reducing agent, is represented by the following formula (II) or (III). The terms "inorganic value" and "organic value" used herein are defined in Atsusi Fujita and Masami Akatsuka, *Keitoteki Yuki Teisei Bunseki* (*Kongobutsu Hen*) (Systematic Organic Qualitative Analysis (Mixtures)) (1974), and Yoshio Kohda, *Yuki Gainenzu* (*Kiso to Ohyoh*) (Organic Concept Diagram (Fundamentals and Applications)) (1984), etc.

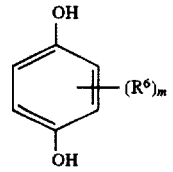

(II)

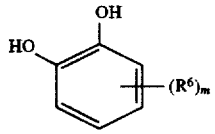

(III)

Examples of substituent represented by $R^6$ in formula (II) and formula (III) include the substituents exemplified for $R^5$ in formula (I), and m represents an integer of from 0 to 4. When m is 2 or more, a plurality of $R^6$ may be the same or different. When two of a plurality of $R^6$ each occupies the ortho position of the other, they may bond each other to form a ring. However, the total carbon number of a plurality of $R^6$ is preferably 18 or less so that the reducing agent satisfies $120 \leqq$ organic value $\leqq 400$. If the organic value exceeds 400, the maximum density of the image is decreased, the image contrast is lowered, and the halftone image quality (distinctness and sharpness of the edge of the halftone image) is deteriorated. It is therefore unfavorable.

Accordingly, the total carbon number of a plurality of $R^6$ is more preferably from 1 to 12.

Although the upper limit of the inorganic value has not appreciably the meaning, it is generally about 3,000.

Preferred examples of $R^6$ include a halogen atom, alkyl groups, alkoxyl groups, aryl groups and acyl groups.

m is preferably 1 or 2.

A plurality of compounds of formula (II) or (III) may bond each other to form a multimer such as a dimer or more.

Specific examples of the compounds represented by formula (I), formula (II) and formula (III) are shown below, but are not limited thereto.

| | | Inorganic Value/Organic Value |
|---|---|---|
| (I-1) | 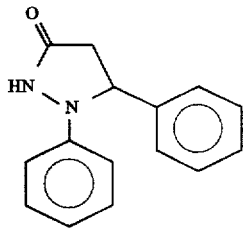 | |
| (I-2) | 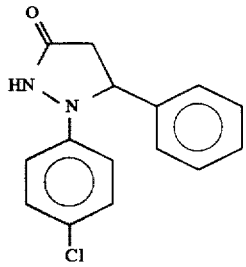 | |
| (I-3) | 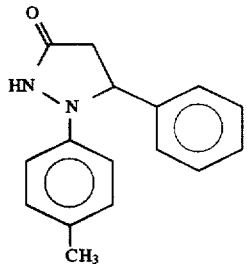 | |
| (I-4) | 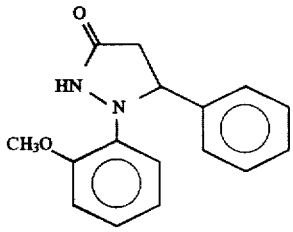 | |
| (I-5) | 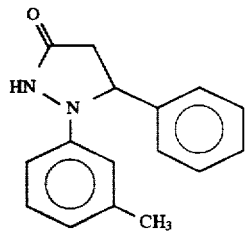 | |

-continued
| | | Inorganic Value/Organic Value |
|---|---|---|
| (I-6) | 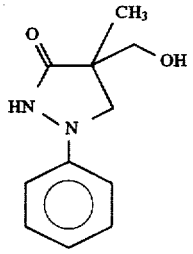 | |
| (I-7) | 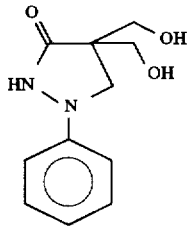 | |
| (I-8) | 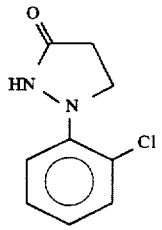 | |
| (I-9) | 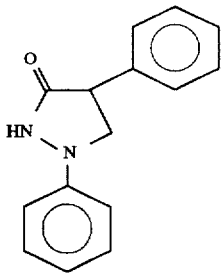 | |
| (I-10) | 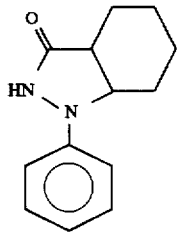 | |
| (II-1) | 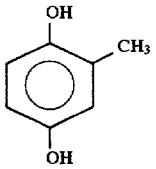 | 215/140 |

-continued
| | | Inorganic Value/Organic Value |
|---|---|---|
| (II-2) | 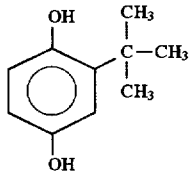 | 215/180 |
| (II-3) | 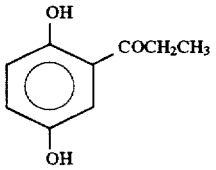 | 280/180 |
| (II-4) | 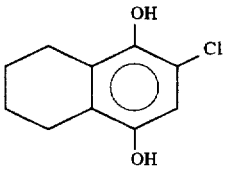 | 235/240 |
| (II-5) | 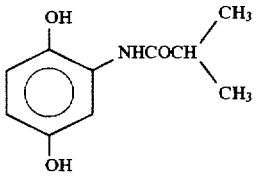 | 415/190 |
| (II-6) | 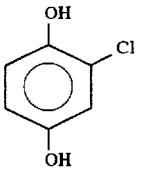 | 225/160 |
| (II-7) | 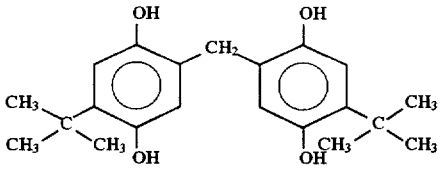 | 430/380 |
| (II-8) | 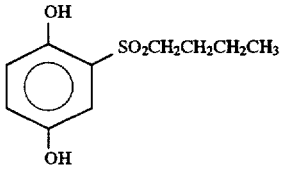 | 385/240 |
| (II-9) | 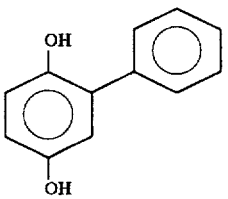 | 230/240 |

-continued
| | | Inorganic Value/Organic Value |
|---|---|---|
| (II-10) | 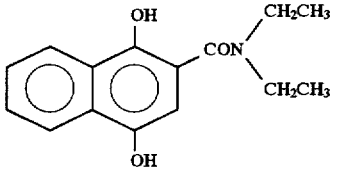 | 460/300 |
| (II-11) | 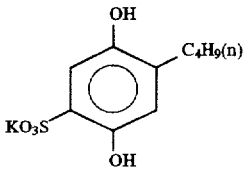 | 965/200 |
| (II-12) | 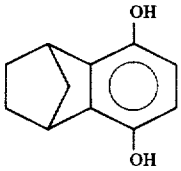 | |
| (II-13) | 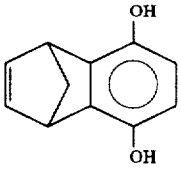 | |
| (II-14) | 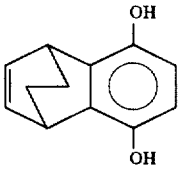 | |
| (II-15) | 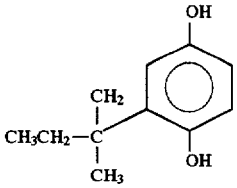 | |
| (II-16) | 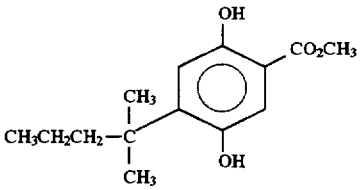 | |
| (II-17) | 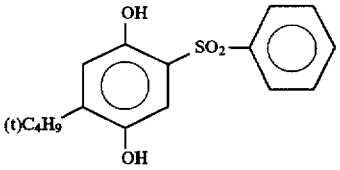 | |

-continued
| | | Inorganic Value/Organic Value |
|---|---|---|
| (II-18) | 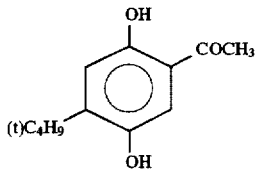 | |
| (II-19) | 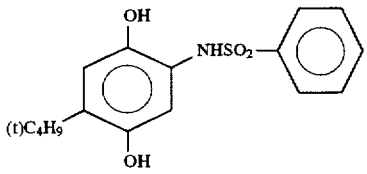 | |
| (II-20) | 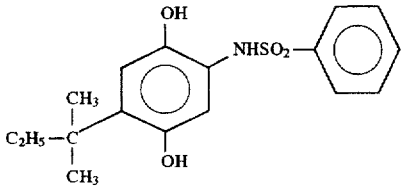 | |
| (II-21) | 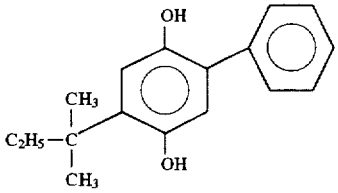 | |
| (II-22) | 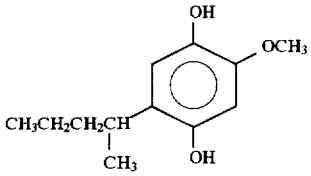 | |
| (III-1) | 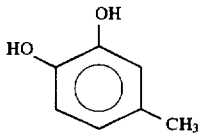 | 215/140 |
| (III-2) | 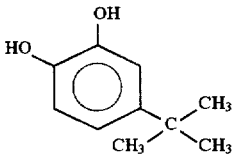 | 215/180 |
| (III-3) | 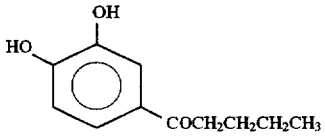 | 280/220 |
| (III-4) | 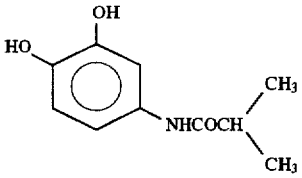 | 415/190 |

-continued
| | | Inorganic Value/Organic Value |
|---|---|---|
| (III-5) | 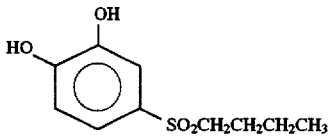 | 385/240 |
| (III-6) | 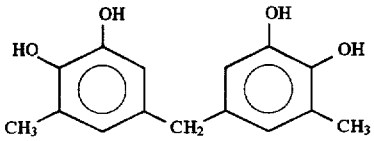 | 430/300 |
| (III-7) | 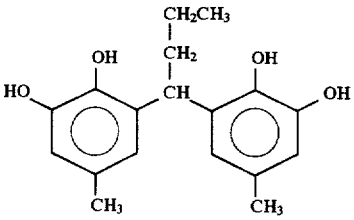 | 430/350 |
| (III-8) | 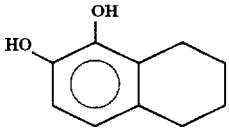 | 225/200 |
| (III-9) | 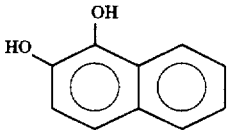 | 260/200 |
| (III-10) | 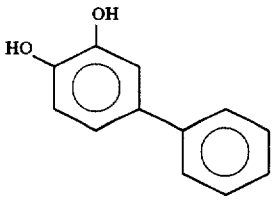 | 230/240 |
| (III-11) | 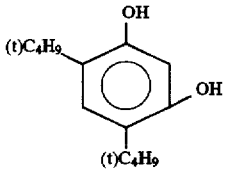 | |
| (III-12) | 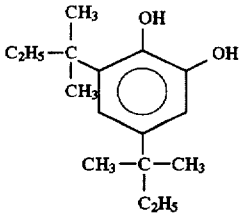 | |

-continued
| | | Inorganic Value/Organic Value |
|---|---|---|
| (III-13) | 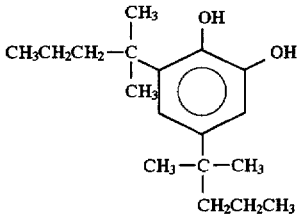 | |
| (III-14) | 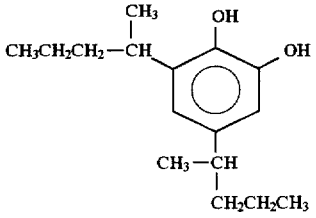 | |
| (III-15) | 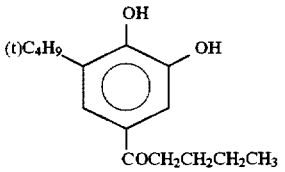 | |
| (III-16) | 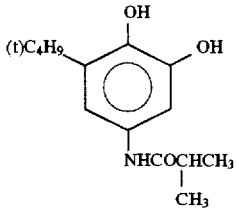 | |
| (III-17) | 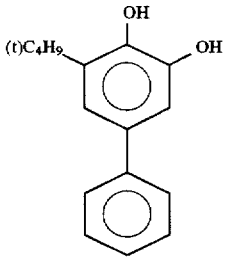 | |
| (III-18) | 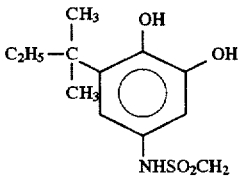 | |
| (III-19) | 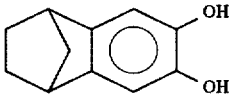 | |
| (III-20) | 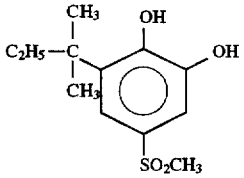 | |

-continued

| | | Inorganic Value/Organic Value |
|---|---|---|
| (III-21) | 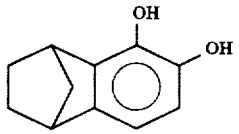 | |

In the present invention, the catechol compounds represented by the above-described general formula (III) are preferably used in terms of performance and further of safety such as low stimulation and sensitization.

In the present invention, the dihydroxybenzene compound relatively high in hydrophilicity is used in combination with the 1-phenyl-3-pyrazolidone compound as reducing agents as described above, thereby making it possible to provide an image low in fog and high in density. Further, in a preferred embodiment, the ratio of the 1-phenyl-3-pyrazolidone compound is significantly increased compared with compositions of the conventional PQ developing solutions to the extent that the molar ratio of the 1-phenyl- 3-pyrazolidone compound to the dihydroxybenzene compound is from 95:5 to 50:50. This make it possible to obtain high contrast images and excellent halftone images without using a nucleating agent. Such an effect is hardly expected from conventional wet development processings. In the present invention, the molar ratio of the 1-phenyl-3-pyrazolidone compound to the dihydroxybenzene compound is more preferably from 90:10 to 60:40.

If the molar ratio of the 1-phenyl-3-pyrazolidone compound to the dihydroxybenzene compound deviates from 95:5 to 50:50, the minimum density is increased or the halftone image quality is deteriorated.

The above-described effects becomes conspicuous, when the sheet containing a complex forming compound, a solvent for a silver halide and a physical developing nucleus (hereinafter referred to as "complexing agent sheet") are allowed to further contain a mordant. That is, the reason for this effect is presumed to be that when a processing is conducted using the mordant-containing complexing agent sheet, the proportion of an unreacted dihydroxybenzene compound and an oxidized product thereof distributed to the complexing agent sheet side becomes larger by virtue of mordanting. Accordingly, when using the mordant-containing complexing agent sheet, images having less stain are preferably obtained, particularly, in case that the photosensitive material side is used for image.

Known mordants in the photographic field can be used. Specific examples thereof include mordants described in U.S. Pat. No. 4,500,626 at columns 58 and 59, JP-A-61-88256 at pages 32 to 41, and JP-A-1-161236 at pages 4 to 7, and mordants described in U.S. Pat. Nos. 4,774,162, 4,619,883 and 4,594,308. Further, dye accepting polymer compounds as described in U.S. Pat. No. 4,463,079 may also be used.

In the present invention, the above-described reducing agents may be added to the photosensitive material, the complexing agent sheet or water used in processing. They are preferably contained in the photosensitive material or the complexing agent sheet, and particularly in the photosensitive material. When they are contained in the photosensitive material or the complexing agent sheet, the layer to which the reducing agents are added can be arbitrarily selected from a photosensitive layer, an intermediate layer, a protective layer, an antihalation layer, a physical developing nuclei-containing layer, etc. However, the reducing agents are preferably added to the photosensitive layer or a layer adjacent thereto on the support side. The reducing agents may be added to a plurality of layers with being divided. The 1-phenyl-3-pyrazolidone compound and the dihydroxybenzene compound may be added to either the same layer or different layers.

The total amount of the above-described reducing agents used is 0.1 to 10 mol, preferably 0.5 to 2 mol, per mol of silver. When the amount is within this range, the reducing agents are effectively consumed for silver development, resulting in inhibition of stain development on images after processed.

In the present invention, the slightly water-soluble basic metal compound for use in the photosensitive material and the compound which can undergo a complex formation reaction with the metal ion constituting the above-described basic metal compound (complex forming compound) for use in the complexing agent sheet are used as base precursors. (The term "slightly water-soluble" used herein means the solubility to water (the amount (g) of a substance which can dissolves in 100 g of water) of not more than 0.5 at 20° C.) That is, these compounds undergo a complex formation reaction in the presence of water, resulting in releasing a base. Combinations of the slightly soluble basic metal compound and the complex forming compound are disclosed in JP-A-62-129848, EP-A-210,660 and U.S. Pat. No. 4,740,445.

Preferred examples of the slightly soluble basic metal compound include oxides, hydroxides and basic carbonates of zinc or aluminum. Of these, zinc oxides, zinc hydroxides and basic zinc carbonates are particularly preferred.

The slightly soluble basic metal compound is used with being dispersed as fine particles in a hydrophilic binder, as described in JP-A-59-174830. The mean particle size of the fine particles is generally from 0.001 to 5 μm, and preferably from 0.01 to 2 μm. The amount of the fine particles of the slightly soluble basic metal compound in the photosensitive material is generally from 0.01 g/m$^2$ to 5 g/m$^2$, preferably from 0.05 to 2 g/m$^2$.

Known compounds as a chelating agent in analytical chemistry and those as a hard water softener in photochemistry can be used as the complex forming compound used in the complexing agent sheet. Details thereof are described in A. Ringbom, translated by Nobuyuki Tanaka and Haruko Sugi, *Saku Keisei Hannoh* (Complex Formation Reaction) (Sangyo Tosho), as well as the above-described patent specifications. The complex forming compounds preferably used in the present invention are water-soluble compounds, which include, for example, aminopolycarboxylic acids (including salts thereof) such as ethylenediaminetetraacetic acid, nitrilo-triacetic acid and diethylenetriaminepentaacetic acid, aminophosphonic acids (including salts thereof) such as aminotris(methylene-phosphonic acid) and ethylenediaminetetramethylenephosphonic acid, and pyridinecarboxylic acids (including salts thereof) such as 2-picolinic acid, pyridine-2,6-dicarboxylic acid and 5-ethyl-2-picolinic acid. Of these, pyridinecarboxylic acids (including salts thereof) are particularly preferred.

In the present invention, it is preferred that the complex forming compound is used in the form of a salt neutralized with a base. In particular, salts with an organic base such as guanidines, amidines and tetraalkylammonium hydroxides, and salts with an alkali metal such as sodium, potassium and lithium are preferred. Preferred specific examples of the complex forming compound are described in the above described JP-A-62-129848 and EP-A-210,660. The amount of the complex forming compound contained in the complexing agent sheet is from 0.01 to 10 g/m$^2$, and preferably from 0.05 to 5 g/m$^2$.

In the present invention, the physical developing nucleus is allowed to be contained in the complexing agent sheet. The physical developing nucleus reduces a soluble silver salt diffused from the photosensitive material to convert them into a physically developed silver, to thereby fix it to the complexing agent sheet. All nuclei known as the physical developing nucleus, such as heavy metals (e.g., zinc, mercury, lead, cadmium, iron, chromium, nickel, tin, cobalt and copper), noble metals (e.g., palladium, platinum, silver and gold), or colloidal particles of chalcogen compounds thereof with sulfur, selenium and tellurium, can be used as the physical developing nuclei. These physical development nucleus substances are obtained by reducing the corresponding metal ions with a reducing agent such as ascorbic acid and sodium boron hydride to produce a metal colloidal dispersion, or by mixing a solution of a soluble sulfide, selenide or telluride to produce a colloidal dispersion of water-insoluble metal sulfide, metal selenide or metal telluride. These dispersions are preferably formed in a hydrophilic binder such as gelatin. The preparation method of colloidal silver particles is described in U.S. Pat. No. 2,688,601. The salt removal process for removing excess salts which is known in the preparation method of a silver halide emulsion may be performed as needed.

The above described physical developing nucleus is generally contained in the complexing agent sheet generally in an amount of from $10^{-3}$ to 100 mg/m$^2$, and preferably in an amount of from $10^{-2}$ to 40 mg/m$^2$.

The physical developing nucleus can be separately prepared and added to a coating solution. However, the physical development nuclei can also be produced by, for example, allowing silver nitrate and sodium sulfide, or chloroauric acid and a reducing agent to react with each other in a coating solution containing a hydrophilic binder.

As the physical developing nuclei, silver, silver sulfide, palladium sulfide, etc. are preferably used. When physically developed silver transferred to the complexing agent sheet is used as an image, palladium sulfide, silver sulfide, etc. are preferably used because the resulting Dmin decreases.

The physical developing nucleus is preferably contained in the outermost layer (a layer contacting with an emulsion layer of the photosensitive material) of the complexing agent sheet.

As the solvent for a silver halide used in the complexing agent sheet of the present invention, known solvents can be used. For example, thiosulfates such as sodium thiosulfate and ammonium thiosulfate, sulfites such as sodium sulfite, organic thioether compounds such as 1,8-dihydroxy-3,6-dithiaoctane, 2,2-thiodiethanol and 6,9-dioxa-3,12-dithiatetradecane-1,14-diol described in JP-B-47-11386, compounds having a 5- or 6-membered imide ring such as uracil and hydantoin described in Japanese Patent Application No. 6-325350 (corresponding to EP-A-722119), mesoionic thiolate compounds such as trimethyl thiolate described in *Analytica Chemica Acta*, vol. 248, pages 604 to 614, and compounds represented by the following general formula as described in JP-A-53-144319 can be used.

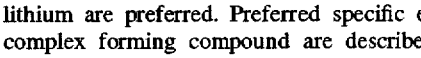

$$N(R^1)(R^2)—C(=S)—X—R^3$$

wherein X represents a sulfur atom or an oxygen atom; $R^1$ and $R^2$, which may be the same or different, each represents an aliphatic group, an aryl group, a heterocyclic group or an amino group; $R^3$ represents an aliphatic group or an aryl group; and $R^1$ and $R^2$ or $R^2$ and $R^3$ may bond each other to form a 5- or 6-membered heterocyclic ring.

In the present invention, of the above-described compounds, compounds having a 5- or 6-membered imide ring such as uracil and hydantoin are particularly preferred.

The amount of the solvent for a silver halide in complexing agent sheet is generally from 0.01 to 5 g/m$^2$, and preferably 0.05 to 2.5 g/m$^2$. Further, the amount is generally from 1/20 to 20 times, preferably from 1/10 to 10 times the coated silver amount of the photosensitive material in molar ratio. The solvent for a silver halide may be dissolved in a solvent such as water, methanol, ethanol, acetone and DMF or an aqueous solution of an alkali such as sodium hydroxide and potassium hydroxide to add them to a coating solution, or dispersed as fine solid particles to add them to coating solutions.

In the present invention, polymers having a repeating unit of vinylimidazole and/or vinylpyrrolidone described in Japanese Patent Application No. 6-325350 (corresponding to EP-A-722119) as a constituent can be added to the complexing agent sheet, to thereby increase the silver image density on the photosensitive material.

The photosensitive material for use in the present invention basically comprises a support having thereon a photosensitive silver halide, a hydrophilic binder and a slightly water-soluble basic metal compound, and can further having, a reducing agent, an organic metal salt oxidizing agent, a dye donating compound, etc., if necessary.

In many cases, these components are added to the same layer. However, they can be separately added to different layers. The reducing agent is preferably contained in the photosensitive material. However, they may be supplied from the outside, for example, by diffusing it from the complexing agent sheet. Further, the photosensitive silver halide emulsion layer may be divided into two or more layers as needed.

Between the above-described silver halide emulsion layers, and as the uppermost and lowermost layers of the photosensitive material, various non-photosensitive layers such as a protective layer, an undercoat layer, an intermediate layer, a filter layer and an antihalation layer may be provided. On the opposite side of the support, various auxiliary layers such as a back layer may be provided. Specifically, the photosensitive material can be provided with an undercoat layer as described in U.S. Pat. No. 5,051,335, an intermediate layer containing a reducing agent or a DIR compound as described in JP-A-1-120553, JP-A-5-34884 and JP-A-2-64634, an intermediate layer containing an electron transfer agent as described in U.S. Pat. Nos. 5,017,454 and 5,139,919 and JP-A-2-235044, a protective layer containing a reducing agent as described in JP-A-4-249245, or two or more of the above layers in combination.

When the support is polyethylene-laminated paper containing a white pigment such as titanium oxide, it is preferred that the back layer is designed to have an antistatic function and a surface resistivity of $10^{12}$ Ω.cm or less.

In the present invention, various silver halides such as silver chloride, silver bromide, silver iodochloride, silver chlorobromide, silver iodobromide and silver iodochlorobromide can be used as the photosensitive silver halide. Of these, silver chloride, silver iodochloride, silver chlorobromide and silver iodochlorobromide each having a silver chloride content of 80 mol % or more are preferred. More preferably, the silver chloride content is 90 mol % or more. The silver iodide content is preferably 2 mol % or less, more preferably 1 mol % or less, and further 0.5 mol % or less.

The silver halide for use in the present invention may be either the surface latent image type or the internal latent image type. The internal latent image type emulsion is used as direct reversal emulsion in combination with a nucleating agent or a fogging by light. Further, they may be multiple structure grains which have a halogen composition different between the inside portion of the grains and the grain surfaces portion. Further, silver halide emulsions different in composition may be joined by epitaxial junction.

In particular, in a high silver chloride emulsion for use in the present invention, silver halide grains having silver bromide-localized phases in the insides and/or on the surfaces thereof in a layer form or in a non-layer form can also be used. The halogen composition of the above-described localized phase preferably has a silver bromide content of at least 20 mol %, and more preferably above 30 mol %. The silver bromide content of the silver bromide-localized phase can be measured by an X-ray diffraction method, etc. For example, application of X-ray diffraction to silver halide grains is described in C. R. Berry and S. J. Marino, *Photographic Science and Technology*, vol. 2, page 149 (1955) and ibid., vol. 4, page 22 (1957). The silver bromide-localized phase can exist inside the grains, on edges and corners of surfaces of the grains, or on the surfaces thereof. Preferred examples thereof include localized phases formed on the corner portions of the grains with being joined by epitaxial junction.

The form of the silver halide grains for use in the present invention can be selected, according to their purpose, from normal crystals free from twin planes, a single twin containing one twin plane, parallel multiple twins containing two or more parallel twin planes, non-parallel multiple twins containing two or more non-parallel twin planes, spherical grains, potato-like grains, tabular grains having a high aspect ratio and combined systems thereof. The form of twin grains is described in *Shashin Kohgaku no Kiso (Ginen Shashin)* (The Fundamentals of Photographic Engineering (Silver Salt Photograph)), page 163, edited by Nippon Shashin Gakkai, Corona Publishing Co. Ltd.

In the case of normal crystals, the grains having a cubic form comprising a (100) face, those having an octahedral form comprising a (111) face, and those having a dodecahedral form comprising a (110) face can be used. The dodecahedral grains are described in JP-B-55-42737 and JP-A-60-222842, and further reported in *Journal of Imaging Science*, vol. 30, page 247 (1986). Grains having (h11) faces, (hh1) faces, (hk0) faces and (hk1) faces can also be used according to their purpose. Tetradecahedral grains having (111) and (100) faces and grains having (111) and (110) faces can also be used. Polyhedral grains such as octatriacontahedral grains, deformed rhombic tetracosahedral grains, hexatetracontahedral grains and octahexacontahedral grains can also be used as needed.

The tabular grains having a high aspect ratio can also be preferably used. The tabular grains of high silver chloride emulsion grains having (111) faces, are described in U.S. Pat. Nos. 4,399,215, 4,400,463 and 5,217,858 and JP-A-2-32, and the tabular grains of the high silver chloride emulsion grains having (100) faces are described in U.S. Pat. Nos. 4,946,772, 5,275,930 and 5,264,337, JP-A-6-59360 and JP-A-6-308648, EP-A-0534395, etc. Such grains having a high aspect ratio are larger in surface area than normal crystals having the same volume, so that the amount of sensitizing dyes adsorbed can be increased. This is advantageous in terms of color sensitization sensitivity. Further, this is advantageous in terms of covering power, so that high Dmax can be achieved with a small amount of silver. Moreover, they have a feature that the developing activity is high because of their high specific surface area.

The silver halide grains may have any mean grain size, ranging from fine grains having a mean grain size of 0.05 μm or less to large-sized grains having a diameter of the projected area exceeding 10 μm. The mean grain size is preferably from 0.1 to 2 μm, and more preferably from 0.1 to 0.9 μm.

For the grain size distribution, monodisperse emulsions having such a grain size distribution that not less than 80% by weight or number of the total grains fall within the range of ±30% of a mean grain size may be used, and polydisperse emulsions having a wide grain size distribution may also be used. The monodisperse emulsion is preferably used.

Further, for adjusting gradation, two or more kinds of monodisperse silver halide emulsions may be used in combination which have a substantially identical color sensitivity and are different in grain size, as described in JP-A-1-167743 and JP-A-4-223463. The two or more kinds of emulsions may be added to the same layer in admixture or separately constitute different layers. Combinations of two or more kinds of polydisperse silver halide emulsions or combinations of the monodisperse emulsions and the polydisperse emulsions can also be used. Further, two or more kinds of monodisperse silver halide emulsions different in heavy metal content as described below may be used in combination, and two or more kinds of monodisperse silver halide emulsions different in chemical ripening may also be used in combination.

In the course of the preparation of the silver halide emulsions in the present invention, the salt removal process for removing excess salts is preferably conducted. Water washing with noodle may be used which is conducted by gelation of gelatin, and the precipitation process (flocculation) may also be used in which multiply charged anionic inorganic salts (for example, sodium sulfate), anionic surfactants, anionic polymers (for example, polysodium styrenesulfonate) or gelatin derivatives (aliphatic acylated gelatin, aromatic acylated gelatin, aromatic carbamoylated gelatin, etc.) are utilized. Ultrafilters shown in U.S. Pat. No. 4,758,505, JP-A-62-113137, JP-B-59-43727 and U.S. Pat. No. 4,334,012 may also be used, and the spontaneous precipitation process and the centrifugation process may also be used. Usually, the precipitation process is preferably used.

Methods for preparing the silver halide emulsions are described in P. Glafkides, *Chemie et Physique Photographique* (Paul Montel, 1967), G. F. Duffin, *Photographic Emulsion Chemistry* (Focal Press, 1966) and V. L. Zelikman et al., *Making and Coating Photographic Emulsion* (Focal Press, 1964).

The preparation methods may be any of acidic, neutral and ammonia processes. As a type of allowing a soluble silver salt and a soluble halogen salt to react with each other, a single jet process, a double jet process or a combination thereof can be used. A process in which grains are formed in the presence of excess silver ions (a so-called reverse mixing process) can also be used. As one type of double jet process, a process in which the pAg is maintained constant in a liquid phase forming a silver halide, namely a so-called controlled double jet process, can also be used. According to this process, silver halide emulsions are obtained in which the crystal system is regular and the grain size is nearly uniform.

In the preparation of the silver halide emulsions, it is preferred to adjust the pAg and the pH during formation of the grains. The adjustment of the pAg and the pH are described in *Photographic Science and Engineering*, vol. 6, pages 159 to 165 (1962), *Journal of Photographic Science*, vol. 12, pages 242 to 251 (1964), U.S. Pat. 3,655,394 and British Patent 1,413,748.

The use of the solvent for a silver halide during formation of silver halide grains makes it possible to produce silver halide emulsions higher in monodispersibility. Examples of the solvent for silver halides for use in the formation include thiocyanates (described in U.S. Pat. Nos. 2,222,264, 2,448,534 and 3,320,069), thioether compounds (described in U.S. Pat. Nos. 3,271,157, 3,574,628, 3,704,130, 4,297,439 and 4,276,347), thione compounds (described in JP-A-53-144319, JP-A-53-82408 and JP-A-55-77737), imidazole compounds (described in JP-A-54-100717), benzimidazole compounds (described in JP-B-60-54662) and amine compounds (described in JP-A-54-100717). Ammonia can also be used in combination with the solvent for a silver halide as long as it does not exert an adverse effect. Nitrogen-containing compounds as described in JP-B-46-7781, JP-A-60-222842, JP-A-60-122935, etc. can be added in the formation stage of the silver halide grains. Details of specific examples of the solvent for a silver halide are described in JP-A-62-215272, pages 12 to 18.

In the course of the grain formation or physical ripening of the silver halide grains, metal salts (including complex salts) may be allowed to coexist. Examples of the metal salt include salts and complex salts of noble metals and heavy metals such as iridium, rhodium, ruthenium, chromium, cadmium, zinc, lead, thallium, platinum, palladium, osmium and rhenium. Of these, salts and complex salts of iridium, rhodium, ruthenium and chromium are preferred. These compounds may be used alone or as a combination of two or more thereof. The addition amount is generally about from $10^{-9}$ to $10^{-3}$ mol, particularly preferably from $10^{9}$ to $5\times10^{-6}$ mol, per mol of silver halide. As the complex ion and the coordination compound, bromine ion, chlorine ion, cyanogen ion, nitrosyl ion, thionitrosyl ion, water, ammonia and combinations thereof are preferably used. For example, yellow prussiate, $K_2IrCl_6$, $K_3IrCl_6$, $(NH_4)_2RhCl_5(H_2O)$, $K_2RuCl_5(NO)$, $K_3Cr(CN)_6$, etc. are preferably used. For the positions of the silver halide grains into which they are incorporated, they may be uniformly incorporated into the grains, localized in the insides or on the surfaces of the grains, in the silver bromide-localized phases or in the high silver chloride grain bases. These compounds are added by mixing a solution of a metal salt with an aqueous solution of a halide in formation of the grains, by adding fine grains of the silver halide emulsion doped with a metal ion, or by directly adding a solution of a metal salt during or after formation of the grains. In order to increase the sensitivity and the density at high illumination exposure, complex metal salts having a cyanogen ion such as iridium and yellow prussiate as a ligand, lead chloride, cadmium chloride and zinc chloride can be preferably used. When spectral sensitization is conducted, complex metal salts having a cyanogen ion such as yellow prussiate as a ligand, lead chloride, cadmium chloride and zinc chloride are preferably used. For enhancing contrast, iridium salts, rhodium salts, ruthenium salts and chromium salts are preferably used.

The addition rate, the addition amount or the addition concentration of the silver salt solution (for example, an aqueous solution of $AgNO_3$) and the halogen compound solution (for example, an aqueous solution of KBr) which are added in the formation of the silver halide grains may be increased to speed up the rate of grain formation. Methods for thus rapidly forming the silver halide grains are described in British Patent 1,335,925, U.S. Pat. Nos. 3,672,900, 3,650,757 and 4,242,445, JP-A-55-142329, JP-A-55-158124, JP-A-58-113927, JP-A-58-113928, JP-A-58-111934 and JP-A-58-111936.

Halogen which forms slightly soluble silver halide grains on surfaces of the silver halide grains during or after grain formation may be substituted for (halogen conversion). This halogen conversion process is described in *Die Grundlagen der Photographischen Prozesse mit Silverhalogeniden*, pages 662 to 669, and *The Theory of Photographic Process*, the fourth edition, pages 97 and 98. In this process, halogen may be added either in the form of a solution of a soluble halide or in the form of fine silver halide grains.

The silver halide emulsions of the present invention can be used as they are not chemically sensitized, but are usually subjected to chemical sensitization before use. With respect to chemical sensitization for use in the present invention, chalcogen sensitization such as sulfur sensitization, selenium sensitization and tellurium sensitization, noble metal sensitization using gold, platinum, palladium, etc., and reduction sensitization can be used alone or in combination, as described, for example, in JP-A-3-110555, JP-A-5-241267, etc. Such chemical sensitization can be conducted in the presence of nitrogen-containing heterocyclic compounds as described in JP-A-62-253159. Further, antifoggants described below can be added after termination of chemical sensitization. Specifically, methods described in JP-A-5-45833 and JP-A-62-40446 can be used.

As the sulfur sensitizer, unstable sulfur compounds are used. Specifically, known sulfur compounds such as thiosulfates (for example, hypo), thiourea derivatives (for example, diphenyl-thiourea, triethylthiourea and allylthiourea), allyl isothio-cyanate, cystine, p-toluenethiosulfonates, rhodanine derivatives and mercapto compounds may be used. The sulfur sensitizer may be added in an amount sufficient to effectively enhancing the sensitivity of the emulsions, and preferably used within the range of $10^{-9}$ to $10^{-1}$ mol per mol of silver halide as a guide, although the suitable amount thereof varies in balance with the pH, the temperature and other sensitizers, and depending on various conditions such as the size of the silver halide grains.

In the selenium sensitization, known unstable selenium compounds are used. Specifically, colloidal metallic selenium, selenourea derivatives (for example, N,N-dimethylselenourea, N,N-diethylselenourea, etc.), selenoketones, selenoamides, aliphatic isoselenocyanates (for example, allyl isoseleno-cyanate, etc.), selenocarboxylic acids and esters thereof, selenophoshpates and selenides such as diethyl selenides and diethyl diselenides. The selenium sensitizer are preferably used within the range of $10^{-10}$ to $10^{-1}$ mol per mol of silver halide as a guide, although the addition amount varies depending on various conditions as is the case with the sulfur sensitizers.

In the present invention, noble metal sensitization can also be employed, in addition to the above-described chalcogen sensitization. First, in gold sensitization, the valence of gold may be either +1 or +3, and various kinds of gold compounds can be used. Typical examples thereof include chloroauric acid compounds such as potassium chloroaurate, auric trichloride, potassium aurothiocyanate, potassium iodoaurate, tetraauric acid, ammonium aurothiocyanate, pyridyltrichloro-gold, gold sulfide, gold selenide and gold telluride.

The gold sensitizer is preferably used within the range of $10^{-10}$ to $10^{-1}$ mol per mol of silver halide as a guide, although the amount added varies depending on various conditions.

The gold sensitizer may be added simultaneously with sulfur sensitization, selenium sensitization or tellurium sensitization, or during, before or after sulfur sensitization, selenium sensitization or tellurium sensitization. It is also possible to use the gold sensitizers alone.

There is no particular limitation on the pAg and the pH of the emulsion which is subjected to sulfur sensitization, selenium sensitization, tellurium sensitization or gold sensitization in the present invention. However, the pAg is preferably within the range of 5 to 11, and the pH is preferably within the range of 3 to 10. More preferably, the pAg is within the range of 6.8 to 9.0, and the pH is within the range of 5.5 to 8.5.

In the present invention, noble metals other than gold can also be used as a chemical sensitizer. As the noble metals other than gold, for example, salts of metals such as platinum, palladium, iridium and rhodium, and complex salts thereof can also be used.

In the present invention, reduction sensitization can be further conducted. As the reduction sensitizer for use in the present invention, ascorbic acid, stannous salts, amines, polyamines, hydrazine compounds, formamidinesulfinic acids, silane compounds, borane compounds, etc. are known. In the present invention, one selected from these known compounds can be used, or two or more kinds thereof can also be used in combination. Preferred examples of the reduction sensitizer include stannous chloride, thiourea dioxide, dimethylamine borane, L-ascorbic acid and aminoiminomethanesulfinic acid. The addition amount of the reduction sensitizer depends on emulsion conditions, and therefore must be selected on occasion. However, suitable addition amount is within the range of $10^{-9}$ to $10^{-2}$ mol per mol of silver halide.

Besides the above-described method of adding the reduction sensitizer, a method of growing or ripening in an atmosphere of a low pAg of from 1 to 7 which is called silver ripening, a method of growing or ripening in an atmosphere of a high pH of from 8 to 11 which is called high pH ripening, or a method of performing reduction sensitization by passing a hydrogen gas or by use of nascent hydrogen produced by electrolysis can also be selected. Further, two or more of them can be used in combination.

This reduction sensitization can be used alone, but can also be used in combination with the above-described chalcogen sensitization or noble metal sensitization.

The amount of the silver halide emulsion for use in the photosensitive material of the present invention is preferably from 0.5 to 2.5 g/m$^2$, particularly preferably from 0.8 to 2.0 g/m$^2$ in terms of the amount of silver.

As protective colloids for use in the preparation of the emulsion in the present invention, gelatin is preferably used, but other hydrophilic colloids can also be used. The hydrophilic colloid can be used alone or in combination with gelatin. Examples of the hydrophilic colloid preferably used in the present invention include proteins such as gelatin compounds, graft polymers of gelatin with other polymers, albumin and casein; cellulose derivatives such as hydroxyethyl cellulose and cellulose sulfates; sodium alginate; starch compounds; polysaccharides; carrageenan; and synthetic hydrophilic polymers such as homopolymers and copolymers of polyvinyl alcohol, modified alkyl polyvinyl alcohols, poly-N-vinylpyrrolidones, polyacrylic acids, polymethacrylic acids, polyacrylamides, polyvinylimidazoles and polyvinylpyrazoles. Thioether polymers described in U.S. Pat. No. 3,615,624 can also be preferably used.

As gelatin, gelatin derivatives such as acid-treated gelatin, delimed gelatin and phthalated gelatin, and low molecular weight gelatin, besides lime-treated gelatin, can be used. Gelatin oxidized with an oxidizing agent such as hydrogen peroxide and enzyme-treated gelatin can also be used. Hydrolyzed or enzymatically decomposed products of gelatin can also be used.

The photosensitive silver halide emulsion for use in the present invention may be spectrally sensitized with a methine dye or the like.

Examples of the dye include cyanine dyes, merocyanine dyes, complex cyanine dyes, complex merocyanine dyes, holopolarcyanine dyes, hemicyanine dyes, styryl dyes and hemioxanol dyes. The particularly useful dyes are dyes belonging to the cyanine dyes, the merocyanine dyes and the complex merocyanine dyes.

Compounds which exhibit supersensitization may be contained in the emulsion together with the sensitizing dye, even if they have no spectral sensitization action themselves or do not substantially absorb visible light.

The time when the dye is added to the emulsion may be any stage of the emulsion preparation. Most normally, the dye is added during a period from completion of chemical sensitization up to before coating, but can be added simultaneously with addition of the chemical sensitizer to conduct spectral sensitization and chemical sensitization at the same time as described in U.S. Pat. Nos. 3,628,969 and 4,225,666, or can be added prior to chemical sensitization as described in JP-A-58-113928 and JP-A-4-63337. Further, they can also be added before completion of precipitation formation of the silver halide grains to initiate spectral sensitization. Furthermore, it is also possible to add these compounds in parts, namely to add a part thereof prior to chemical sensitization and the residue after chemical sensitization, as taught in U.S. Pat. No. 4,225,666, and they may be added at any time during formation of the silver halide grains, including methods taught in U.S. Pat. No. 4,183,756.

In order to enhance adsorption of the sensitizing dye, soluble Ca compounds, soluble Br compounds, soluble I compounds, soluble Cl compounds or soluble SCN compounds may be added before, after or during addition of the sensitizing dye. These compounds may be used in combination. $CaCl_2$, KI, KCl, KBr and KSCN are preferably used. Further, they may be fine grains of silver bromide, silver chlorobromide, silver iodobromide, silver iodide and silver rhodanide emulsion grains.

There is no particular limitation on other additives for use in a photosensitive material to which the emulsion of the present invention is applied. For example, reference can be made to the descriptions of *Research Disclosure*, vol. 176, item 17643 (RD-17643), ibid., vol. 187, item 18716 (RD-18716), ibid., vol. 307, item 307105 (RD-307105), etc.

As to additives for use in such stages and known photographic additives available in the photosensitive material and the complexing agent sheet for use in the present invention, portions of RD-17643, RD-18716 and RD-307105 are listed in which the various additives are described.

| | Type of Additives | RD17643 | RD18716 | RD307105 |
|---|---|---|---|---|
| 1. | Chemical Sensitizers | p. 23 | p. 648, right column | p. 866 |
| 2. | Sensitivity Increasing Agents | | ditto | |
| 3. | Spectral Sensitizers, Supersensitizers | pp. 23–24 | p. 648, right column to p. 649, right column | pp. 866–868 |
| 4. | Brightening Agents | p. 24 | p. 648, right column | p. 868 |
| 5. | Antifoggants, Stabilizers | pp. 24–25 | p. 649, right column | pp. 868–870 |
| 6. | Light Absorbers, Filter dyes, UV Absorbers | pp. 25–26 | p. 649, right column to p. 650, left column | p. 873 |
| 7. | Stain Inhibitors | p. 25, right column | p. 650. left column to right column | |
| 8. | Dye Image Stabilizers | p. 25 | p. 650, left column | p. 872 |
| 9. | Film Hardeners | p. 26 | p. 651, left column | pp. 874–875 |
| 10. | Binders | p. 26 | ditto | pp. 873–874 |
| 11. | Plasticizers, Lubricants | p. 27 | p. 650, right column | p. 876 |
| 12. | Coating Aids, Surfactants | pp. 26–27 | ditto | pp. 875–876 |
| 13. | Antistatic Agents | p. 27 | ditto | pp. 876–877 |
| 14. | Matting Agents | | | pp. 878–879 |

Further, the compounds shown below can also be used.

| Item | Corresponding Portions |
|---|---|
| 1) Silver Halide Emulsions and the Preparation Thereof | JP-A-2-97937, pages 20, lower right column, line 12 to page 21, lower left column, line 14; JP-A-2-12236, page 7, upper right column, line 19 to page 8, lower left column, line 12; JP-A-4-330430; and JP-A-5-011389 |
| 2) Spectral Sensitizing Dyes | Spectral sensitizing dyes described in JP-A-2-55349, page 7, upper left column, line 8 to page 8, lower right column, line 8; JP-A-2-39042, page 7, lower right column, line 8 to page 13, lower right column, line 5; JP-A-2-12236, page 8, lower left column, line 13 to lower right column, line 4; JP-A-2-103536, page 16, lower right column, line 3 to page 17, lower left column, line 20; JP-A-1-112235; JP-A-2-124560; JP-A-3-7928; and JP-A-5-011389 |
| 3) Surfactants Antistatic Agents | JP-A-2-12236, page 9, upper right column, line 7 to lower right column, line 7; and JP-A-2-18542, page 2, lower left column, line 13 to page 4, lower right column, line 8 |
| 4) Antifoggants Stabilizers | Thiosulfinic acids described in JP-A-2-103536, page 17, lower right column, line 19 to page 18, upper right column, line 4 and page 18, lower right column, line 1 to line 5; and JP-A-1-237538 |
| 5) Polymer Latexes | JP-A-2-103536, page 18, lower left column, line 12 to line 20 |
| 6) Compounds Having Acid Groups | JP-A-2-103536, page 18, lower right column, line 6 to page 19, upper left column, line 1; and JP-A-2-55349, page 8, lower right column, line 13 to page 11, upper left column, line 8 |
| 7) Polyhydroxybenzenes | JP-A-2-55349, page 11, upper left column, line 9 to lower right column, line 17 |
| 8) Matting Agents Lubricants Plasticizers | JP-A-2-103536, page 19, upper left column, line 15 to upper right column, line 15 |
| 9) Film Hardener | JP-A-2-103536, page 18, upper right column, line 5 to line 17 |
| 10) Dyes | JP-A-2-103536, page 17, upper right column, line 1 to line 18; and JP-A-2-39042, page 4, upper right column line 1 to page 6, upper right column, line 5 |
| 11) Binders | JP-A-2-18542, page 3, lower right column, line 1 to line 20 |
| 12) Black Spot Inhibitors | Compounds described in U.S. Pat. No. 4,956,257 and JP-A-1-118832 |
| 13) Redox Compounds | Compounds represented by general formula (I) of JP-A-2-301743 (particularly, compound examples 1 to 50); general formulas (R-1), (R-2) and (R-3) and compounds 1 to 75 described in JP-A-3-174143, pages 3 to 20; and compounds described in JP-A-5-257239 and JP-A-4-278939 |
| 14) Monomethine Compounds | Compounds of general formula (II) of JP-A-2-287532 (particularly compound examples II-1 to II-26) |
| 15) Hydrazine Compounds | Descriptions in JP-A-2-12236, page 2, upper right column line 19 to page 7, upper right column, line 3; and general formula (II) and compound examples II-1 to II-54 of JP-A-3-174143, page 20, lower right column, line 1 to page 27, upper right column, line 20 |
| 16) Nucleating Accelerators | General formulas (II-m) to (II-p) and compounds examples II-1 to II-22 of JP-A-2-103536, page 9, upper right column, line 13 to page 16, upper left column, line 10; and compounds described in JP-A-1-179939 |

Of the above-described additives, preferred examples of the antifoggant and stabilizer include azoles (for example, benzothiazolium salts, nitroimidazole compounds, nitrobenzimidazole compounds, chlorobenzimidazole compounds, bromobenzimidazole compounds, nitroindazole compounds, benzotriazole compounds and aminotriazole compounds); mercapto compounds (for example, mercaptothiazole compounds, mercaptobenzothiazole compounds, mercaptobenzimidazole compounds, mercaptothiadiazole compounds, mercaptotetrazole compounds (particularly, 1-phenyl-5-mercaptotetrazole and derivatives thereof), mercaptopyrimidine compounds and mercaptotriazine compounds); thioketo compounds such as oxazolinethione; azaindene compounds (for example, triazaindene compounds, tetraazaindene compounds (particularly, 4-hydroxy-6-methyl(1,3,3a,7)tetraazaindene compounds) and pentaazaindene compounds); benzenethiosulfones; benzenesulfinic acid; and benzenesulfonic acid amide.

As the binder for constituent layers of the photosensitive material and the complexing agent sheet, hydrophilic binders are preferably used. Examples thereof include binders described in *Research Disclosures* shown above and JP-A-64-13546, pages 71 to 75. Specifically, transparent or translucent hydrophilic binders are preferred, and examples thereof include natural compounds such as proteins (for example, gelatin and gelatin derivatives), polysaccharides (for example, cellulose derivatives, agar, starch, gum arabic, dextran, pullulan, furcerelane, carrageenan described in EP-A-443529, low cast bean gum, xanthane gum and pectin) and polysaccharides described in JP-A-1-221736; and synthetic polymers such as polyvinyl alcohol, modified alkyl polyvinyl alcohols described in JP-A-7-219113, polyvinylpyrrolidone and polyacrylamide. Further, there can also be used high water-absorptive polymers described in U.S. Pat. No. 4,960,681, JP-A-62-245260, etc. namely homopolymers of vinyl monomers having —COOM or —$S_3M$ (wherein M represents a hydrogen atom or an alkali metal), or copolymers of these vinyl monomers with each other or with other monomers. The high water-absorptive polymer is on the market, which include, for example, Sumikagel L-5H manufactured by Sumitomo Chemical Co. Ltd. These binders can also be used in a combination of two or more kinds thereof. Combinations of gelatin and the above-described binder are preferred. Further, gelatin may be selected from lime-treated gelatin, acid-treated gelatin and so-called delimed gelatin reduced in content of calcium, etc., depending on various purposes, and they are also preferably used in combination.

When the system of supplying a small amount of water to conduct heat development is employed, the use of the above-described high water-absorptive polymer makes it possible to rapidly absorb water.

When the gelatin content is low, carrageenan described in EP-A-443529, the modified alkyl polyvinyl alcohols described in JP-A-7-219113 and polysaccharides described in JP-A-6-67330 are preferably used as the hydrophilic polymer other than gelatin for providing good setting property in coating.

The total coating amount of the binders of the photosensitive material and the complexing agent sheet is preferably 12 g/m$^2$ to 0.5 g/m$^2$, particularly 5 g/m$^2$ or less, and further preferably 3 g/m$^2$ or less.

In the present invention, the following agents known in the photosensitive material field can be used in combination with the above-described reducing agents. Further, reducing agent precursors can also be used which themselves have no reductive ability, but exhibit reductive ability by action of nucleophilic reagents or heat during the course of development.

Examples of such reducing agents for use in the present invention include reducing agents and reducing agent precursors described in U.S. Pat. No. 4,500,626 at column 49 and 50, 4,839,272, 4,330,617, 4,590,152, 5,017,454 and 5,139,919, JP-A-60-140335 at pages 17 and 18, JP-A-57-40245, JP-A-56-138736, JP-A-59-178458, JP-A-59-53831, JP-A-59-182449, JP-A-59-182450, JP-A-60-119555, JP-A-60-128436, JP-A-60-128439, JP-A-60-198540, JP-A-60-181742, JP-A-61-259253, JP-A-62-201434, JP-A-62-244044, JP-A-62-131253, JP-A-62-131256, JP-A-63-10151, JP-A-64-13546 at pages 40 to 57, JP-A-1-120553, JP-A-2-32338, JP-A-2-35451, JP-A-2-234158, JP-A-3-160443, European Patent 220,746 at pages 78 to 96, etc.

Combinations of various reducing agents as disclosed in U.S. Pat. No. 3,039,869 can also be used.

Further, electron donor precursors as described in JP-A-3-160443 are also preferably used.

Furthermore, the above-described reducing agents can also be used in an intermediate layer or a protective layer. Specifically, reducing agents described in EP-A-524,649 EP-A-357,040, JP-A-4-249245, JP-A-2-64633, JP-A-2-46450 and JP-A-63-186240 are preferably used. Further, reductive compounds releasing development inhibitors as described in JP-B-3-63733, JP-A-1-150135, JP-A-2-110557, JP-A-2-64634, JP-A-3-43735 and EP-A-451,833 are also used.

In the present invention, an organic metal salt can also be used as an oxidizing agent in combination with the photosensitive silver halide emulsion. Of such organic metal salts, organic silver salts are particularly preferably used.

Organic compounds which can be used for formation of the above-described organic silver salt oxidizing agents include benzotriazole compounds, fatty acids and other compounds described in U.S. Pat. No. 4,500,626, columns 52 and 53. Silver acetylide described in U.S. Pat. No. 4,775,613 is also useful. The organic silver salts may be used in a combination of two or more thereof.

The amount of the above described organic metal salt, which can be used in combination, is generally from 0.01 to 10 mol, preferably from 0.01 to 1 mol, per mol of photosensitive silver halide. The total coating amount of the organic silver salt and the photosensitive silver halide emulsion is generally from 0.05 to 10 g/m$^2$, preferably from 0.4 to 5 g/m$^2$, in terms of silver.

For preventing halation or irradiation, various dyes can be used in the constituent layers of the photosensitive material of the present invention. The dye is preferably dispersed as fine solid grains to incorporate it into the photosensitive material, as disclosed in JP-A-3-7931 and JP-A-2-308242. Specifically, compounds described in *Research Disclosures* shown above and compounds described in JP-A-8-101487 can be used.

In the photosensitive materials of the present invention, compounds for promoting activation of development simultaneously with stabilization of images can be used. Preferred examples of such compounds are described in U.S. Pat. No. 4,500,626, columns 51 and 52.

In the present invention, the image forming substances are, mainly, developed silver contained in the photosensitive material. A dye (a dye donating compound) can be used in the photosensitive material and the complexing agent sheet, as needed. As an example, a presensitized plate has a spectral sensitivity within the wavelength region from 300 nm to 500 nm so as to be treatable in an illuminated room with ultraviolet rays cut, and a dye (a dye donating compound) having an absorption within this wavelength region can be converted to an image together with a silver image, as long as a photosensitive material for printing plate making used as a printing original to the presensitized plate has discrimination within this wavelength region in its image. Further, a black-and-white image can also be obtained by dyes together with silver, using at least two kinds of dye donating compounds forming or releasing dyes substantially different in color tone from each other, or dye donating compounds forming or releasing at least two kinds of dyes substantially different in color tone from each other.

Examples of the dye donating compound available in the present invention include compounds which forms a dye by the oxidation coupling reaction (couplers). The couplers may be either 4-equivalent couplers or 2-equivalent couplers. Further, polymer couplers which nondiffusion group forms a polymer chain are also preferred . Specific examples of color developing agents and the couplers include p-phenylenediamine reducing agents and phenolic or active methylene couplers as proposed in U.S. Pat. No. 3,531,286, p-aminophenol reducing agents in U.S. Pat. No. 3,761,270, sulfonamidophenol reducing agents in Belgian Patent 802,519 and *Research Disclosure*, page 32, Sep. 31, 1975, and combinations of sulfonamidophenol reducing agents and 4-equivalent couplers in U.S. Pat. No. 4,021,240. Other specific examples of the color developing agent and the coupler are also described in T. H. James, *The theory of the Photographic Process*, the fourth edition, pages 291 to 334 and 354 to 361.

As other examples of the dye donating compound, nondiffusion dye donating compounds (thiazolidine compounds) having a heterocyclic ring containing a nitrogen atom and a sulfur atom or selenium atom, the heterocyclic rings being cleaved in the presence of silver ion or a soluble silver complex to release movable dyes as described in JP-A-59-180548, can also be used.

Further examples of the dye donating compound include compounds having the function of releasing or diffusing diffusion dyes imagewise. The compounds of this type can be represented by the following general formula (L1):

$$((Dye)m-Y)n-Z \quad (L1)$$

wherein Dye represents a dye group, a dye group temporarily shifted to a short wavelength, or a dye precursor group; Y represents a bond or a linkage group; Z represents a group which has the property of causing the difference in diffusion characteristics of the compounds represented by ((Dye)m–Y)n–Z reversely corresponding to a photosensitive silver salt having a latent image imagewise, or which releases (Dye)m–Y to produce the difference in diffusion characteristics between (Dye)m–Y released and ((Dye)m–Y)n–Z; m represents an integer of from 1 to 5; n represents from 1 or 2; and when m or n is not 1, a plurality of Dye may be the same or different.

Specific examples of the dye donating compound represented by general formula (L1) include (1) to (3) shown below.

(1) Dye developing agents in which hydroquinone developing agents and dye components are connected to each other, which are described in U.S. Pat. Nos. 3,134,764, 3,362,819, 3,597,200, 3,544,545 and 3,482,972, JP-B-3-68387, etc. These dye developing agents are diffusible under alkaline conditions, but become nondiffusible on reaction with silver halides.

(2) Nondiffusion compounds can also be used which release diffusion dyes under alkaline conditions, but lose their ability on reaction with silver halides as described in U.S. Pat. No. 4,503,137. Examples thereof include compounds releasing diffusion dyes by intermolecular nucleophilic substitution as described in U.S. Pat. No. 3,980,479, etc., and compounds releasing diffusion dyes by intermolecular rearrangement reaction of isooxazolone rings as described in U.S. Pat. No. 4,199,354, etc.

(3) Nondiffusion compounds can also be used which react with residual reducing agents not oxidized by development to release diffusion dyes as described in U.S. Pat. No. 4,559,290, EP-A-220,746, U.S. Pat. No. 4,783,396, Journal of Technical Disclosure 87-6199, JP-A-64-13546, etc.

Examples thereof include compounds which release a diffusion dye by the intermolecular nucleophilic displacement reaction after reduction as described in U.S. Pat. Nos. 4,139,389 and 4,139,379, JP-A-59-185333, JP-A-57-84453, etc., compounds which release a diffusion dye by the intermolecular electron transfer reaction after reduction as described in U.S. Pat. No. 4,232,107, JP-A-59-101649, JP-A-61-88257, *Research Disclosure*, 24025 (1984), etc., compounds which release a diffusion dye by cleavage of a single bond after reduction as described in West German Patent 3,008,588A, JP-A-56-142530, U.S. Pat. Nos. 4,343,893 and 4,619,884, etc., nitro compounds which release a diffusion dye after electron acceptance as described in U.S. Pat. No. 4,450,223, etc., and compounds which release a diffusion dye after electron acceptance as described in U.S. Pat. No. 4,609,610, etc.

More preferred examples thereof include compounds each having an N—X bond (wherein X represents an oxygen atom, a sulfur atom or a nitrogen atom) and an electron attractive group in one molecule as described in European Patent 220,746, Journal of Technical Disclosure 87-6199, U.S. Pat. No. 4,783,396, JP-A-63-201653, JP-A-63-201654, JP-A-64-13546, etc., compounds each having an $SO_2$—X (wherein X has the same meaning as given above) and an electron attractive group in one molecule as described in JP-A-1-26842, compounds each having a PO—X bond (wherein X has the same meaning as given above) and an electron attractive group in one molecule as described in JP-A-63-271344, and compounds each having a C—X' bond (wherein X' has the same meaning as with X, or represents —$SO_2$—) and an electron attractive group in one molecule as described in JP-A-63-271341. Further, compounds described in JP-A-l-161237 and JP-A-l-161342 can also be utilized in which a single bond is cleaved by a $\pi$ bond conjugating with an electron acceptant group after reduction to release a diffusion dye.

Of these, the compounds each having an N—X bond and an electron attractive group in one molecule are particularly preferred.

Colored dye donating compounds may be allowed to exist in a lower photosensitive silver halide emulsion layer, whereby the sensitivity can be prevented from being lowered.

The hydrophobic additives such as the dye donating compounds and the nondiffusion reducing agents can be introduced into the layers of the photosensitive materials by known methods such as methods described in U.S. Pat. No. 2,322,027. In this case, a high boiling organic solvent as described in U.S. Pat. Nos. 4,555,470, 4,536,466, 4,536,467, 4,587,206, 4,555,476 and 4,599,296, JP-A-63-306439, JP-A-62-8145, JP-A-62-30247, JP-B-3-62256, etc. can be used in combination with a low boiling organic solvent having a boiling point of from 50 to 160° C., if necessary. Further, these dye donating compounds, nondiffusion reducing agents and high boiling organic solvents can be used as a combination of two or more kind thereof.

The amount of the high boiling organic solvent is generally 10 g or less per g of hydrophobic additives to be used, preferably 5 g or less, and more preferably from 1 g to 0.1 g. Further, the suitable amount is 1 ml or less per g of binder, further 0.5 ml or less, and particularly suitably 0.3 ml or less.

Furthermore, dispersing methods according to polymerized products described in JP-B-51-39853 and JP-A-51-59943 and methods of adding as dispersed fine grains described in JP-A-62-30242 can also be used.

When the hydrophobic compounds are dispersed in hydrophilic colloids, various surfactants can be used. For example, surfactants described in JP-A-59-157636, pages 37 and 38, and *Research Disclosures* shown above can be used.

Further, phosphate type surfactants described in JP-A-7-056267, JP-A-7-228589 and West German Patent (OLS) 1,932,299A can also be used.

The complexing agent sheet may be provided with auxiliary layers such as a protective layer, a separation layer, an undercoat layer, an intermediate layer, a back layer and a curl prevention layer.

In the constituent layers of the photosensitive material and the complexing agent sheet, a high boiling organic solvent can be used as a plasticizer, a slipping agent or a separation improver of the complexing agent sheets and the photosensitive material. Examples thereof include solvents described in *Research Disclosures* shown above and JP-A-62-245253.

Further, various silicone oils (all silicone oils including dimethylsilicone oils and modified silicone oils in which various organic groups are introduced into dimethylsiloxanes) can be used for the above-described purposes. As examples thereof, various modified silicone oils described in "Modified Silicone Oils", Technical Data P6-18B, published by Shinetsu Silicone Co., particularly carboxy-modified silicone (trade name: X-22-3710), etc., are effective.

Further, silicone oils described in JP-A-62-215953 and JP-A-63-46449 are also effective.

Hardeners used in the constituent layers of the photosensitive material and the complexing agent sheet include hardeners described in *Research Disclosures* shown above, U.S. Pat. No. 4,678,739, column 41, and U.S. Pat. No. 4,791,042, JP-A-59-116655, JP-A-62-245261, JP-A-61-18942, JP-A-4-218044, etc. More specifically, examples thereof include aldehyde hardeners (such as formaldehyde), aziridine hardeners, epoxy hardeners, vinylsulfone hardeners (such as N,N'-ethylene-bis (vinyl-sulfonylacetamido) ethane), N-methylol hardeners (such as dimethylolurea) and polymer hardeners (compounds described in JP-A-62-234157, etc.).

These hardeners are used in an amount of from 0.001 to 1 g, preferably from 0.005 to 0.5 g, per g of hydrophilic binder coated. They may be added to any of the constituent layers of the photosensitive material and the complexing agent sheet, and may be divided to add them to two or more layers.

In the constituent layers of the photosensitive material and the complexing agent sheet, various antifoggants or photographic stabilizers and precursors thereof can be used. Specific examples thereof include compounds described in *Research Disclosures* shown above, U.S. Pat. Nos. 5,089,378, 4,500,627 and 4,614,702, JP-A-64-13546, pages 7 to 9, 57 to 71 and 81 to 97, U.S. Pat. Nos. 4,775,610, 4,626,500 and 4,983,494, JP-A-62-174747, JP-A-62-239148, JP-A-63-264747, JP-A-1-150135, JP-A-2-110557, JP-A-2-178650, RD, 17643 (1978), pages 24 and 25, and JP-A-8-54705. These compounds are preferably used in an amount of from $5\times10^{-6}$ to $1\times10^{-1}$ mol, more preferably from $1\times10^{-5}$ to $1\times10^{-2}$ mol, per mol of silver.

In the constituent layers of the photosensitive material and the complexing agent sheet, various surfactants can be used for assisting coating, improving separation, improving slipperiness, preventing electric charge, and accelerating development. Specific examples of the surfactants are described in *Research Disclosures* shown above, JP-A-62-173463 and JP-A-62-183457.

The constituent layers of the photosensitive material and the complexing agent sheet may contain organic fluoro compounds for improving slipperiness, preventing electric charge and improving separation. Typical examples of the organic fluoro compound include fluorine surfactants described in JP-B-57-9053, columns 8 to 17, JP-A-61-20944 and JP-A-62-135826, and hydrophobic fluorine compounds such as oily fluorine compounds (for example, fluorine oils) and solid fluorine compound resins (for example, ethylene tetrafluoride resins).

In the photosensitive material and the complexing agent sheet, matting agents can be used for preventing adhesion, improving slipperiness and delustering surfaces. Examples of the matting agent include compounds such as benzoguanamine resin beads, polycarbonate resin beads and AS resin beads described in JP-A-63-274944 and JP-A-63-274952, as well as compounds such as silicon dioxide, polyolefins and polymethacrylates described in JP-A-61-88256, page 29. In addition, compounds described in *Research Disclosures* shown above can be used. These matting agents can be added not only to the uppermost layer (protective layer), but also to lower layers, as needed.

Besides, the constituent layers of the photosensitive material and the complexing agent sheet may be allowed to contain heat solvents, antifoaming agents, microbicidal antifungal agents, colloidal silica, etc. Specific examples of these additives are described in JP-A-61-88256, pages 26 to 32, JP-A-3-11338, JP-B-2-51496, etc.

In the present invention, image formation accelerating agents can be used in the photosensitive material and/or the complexing agent sheet. The image formation accelerating agents can be classified into bases or the above-described base precursors, nucleophilic compounds, high boiling organic solvents (oils), heat solvents, surfactants, compounds having interaction with silver or silver ions, etc. according to the physicochemical functions.

However, these groups of substances generally have combined functions, and therefore, they have usually combinations of some of the above-described accelerating effects. Details thereof are described in U.S. Pat. No. 4,678,739, columns 38 to 40. Addition of the high boiling organic solvent to the complexing agent sheet significantly improves a reduction in luster of images of the photosensitive material and the complexing agent sheet after processing.

In the present invention, various development stoppers can be used in the photosensitive material and/or the complexing agent sheet for stably obtaining constant images against fluctuations in processing temperature and processing time on development.

The "development stopper" as used herein is a compound which, after normal development, rapidly neutralizes or reacts with a base to reduce the concentration of the base contained in a film, thereby stopping development, or a compound which interacts with silver and a silver salt to inhibit development. Examples thereof include acid precursors which release an acid by heating, electrophilic compounds which conduct the replacement reaction with coexisting bases by heating, nitrogen-containing heterocyclic compounds, mercapto compounds and precursors thereof. More specifically, they are described in JP-A-62-253159, pages 31 and 32.

In the present invention, supports which can endure processing temperatures are used as supports of the photosensitive material and the complexing agent sheet. In general, the supports include photographic supports such as paper and synthetic polymers (films) described in *Shashin Kohgaku no Kiso (Ginen Shashin)* (The Fundamentals of Photographic Engineering (Silver Photograph)), pages 223 to 240, edited by Nippon Shashin Gakkai, Corona Publishing Co. Ltd. (1979). Specifically, polyethylene terephthalate, polyethylene naphthalate, polycarbonates, polyvinyl chloride, polystyrene, polypropylene, polyimides, polyarylates, cellulose derivatives (for example, cellulose triacetate) or films thereof in which pigments such as titanium oxide are allowed to be contained, synthetic paper produced from propylene by film methods, mixed paper produced from pulp of a synthetic resin such as polyethylene and natural pulp, Yankee paper, baryta paper, coated paper (particularly, cast-coated paper), metals, cloth, glass, etc. can be used.

They can be used alone or as supports each coated with a synthetic polymer such as polyethylene on one side or both sides. The laminated layers can contain pigments such as titanium oxide, ultramarine and carbon black or dyes, if necessary.

In addition, supports described in JP-A-62-253159, pages 29 to 31, JP-A-1-161236, pages 14 to 17, JP-A-63-316848, JP-A-2-22651, JP-A-3-56955 and U.S. Pat. No. 5,001,033 can be used.

Back surfaces of these supports may be coated with a hydrophilic binder, a semiconductive metal oxide such as alumina sols, tin oxide and antimony oxide, and antistatic agents such as carbon black. Specifically, supports described in JP-A-63-220246 can be used.

It is desirable to design so as to give a surface resistivity of $10^{12}$ Ω.cm or less.

Further, for improving adhesion to the hydrophilic binder, various surface treatments or undercoating treatments are preferably applied to surfaces of the supports.

The thickness of the support can be arbitrarily selected within the range of from 20 μm to 300 μm.

The photosensitive material of the present invention can be widely used as black-and-white photosensitive materials for taking, photosensitive materials for medical use (for direct radiography or for computed radiography), photosensitive materials for printing, etc. As to uses of the photosensitive materials for printing, they can be utilized not only as films for scanners, but also as films for halftone photography, films for line work, contact (negative-positive type) films, contact (reversal positive-positive type) films or films for illuminated rooms.

Methods for exposing the heat development photosensitive material of the present invention to record images include, for example, methods of exposing printing an original such as reversal films through a contact screen or a color separation filter using process cameras, methods of using a process printer, and methods of allowing xenon light, emitting diodes, various lasers (such as laser diodes and gas lasers), etc. to emit light by image information through electric signals to subject the photosensitive materials to scanning exposure (methods described in JP-A-2-129625, JP-A-5-176144, JP-A-5-199302, JP-A-6-127021, etc.).

As light sources for recording images on the heat development photosensitive material xenon lamps, tungsten lamps, halogen lamps, metal halide lamps, quartz lamps, light emitting diodes, laser sources, etc. can be used.

Examples of the exposing devices for use in the present invention include commercial Ar laser exposing devices (a DC series of Linotype-Hell Co.), a Magnascan series of Crosfield Co., commercial He-Ne laser exposing devices (an SG series of Dainippon Screen Mfg. Co. Ltd.), a commercial laser exposing devices (Lux Scan of Fuji Photo Film Co., Ltd.), color scanners such as MTR of Dainippon Screen Mfg. Co. Ltd., image setters such as Selectset (He-Ne) and Avantra (Red-LD) of Agfa-Gevaert Co., Herkules (Red-LD) of Linotype-Hell Co., Dolev (He-Ne) of Scitex Co., Accuset (Led-LD) of Agfa-Gevaert Co. and Lux Setter 5600 of Fuji Photo Film Co., Ltd., and exposing devices for facsimile such as 240R of NEC Corp.

Examples of the process printers which can be utilized in the exposure of the present invention include FPA 740, FPA 800, FPA 800X, FPA 800Hg and FPA 800FX of Fuji Photo Film Co., Ltd., a P607 series, a P617 series, a P627 series, a P647 series, a P648 series and a P607 series of Dainippon Screen Mfg. Co., IPB-1000SH of Eyegraphics Co. Ltd., FL2M and FL3M of Ushio Inc., SK-16 of Kuranami Co., Versalite Contact Printer 840H and Contact 2200 Printer of Eastman-Kodak Co., CDL 2002Ri of Agfa-Gevaert Co., P-6, P-4, P-2 and P-8 of Kitamura Co., 0R30 of SACK Co., VDM5 of THIEMER Co., and RD 7087D of CONVAC Co.

Examples of the process cameras which can be utilized in the exposure of the present invention include FCS 820, FCS 820S, FGC 100, FGC 200 and FGC 300 of Fuji Photo Film Co., Ltd., FINE ZOOM 880, ZOOMACE 800, Companica C-680, Companica C-690, a P648 series and a P607 series of Dainippon Screen Mfg. Co., Image Maker 540 of Itec Graphics Co., Opti-Copy 32, Opti-Copy 42, Opti-Copy 23, Image Maker 5060A, Image Maker IM200, Image Maker IM400, Image Maker IM600 and Image Maker IM800 of Eastman-Kodak Co., RPS Camera and a Repromaster series of Agfa-Gevaert Co., Reneas 2000 and a Design Scope series of Izumiya Co. and a Repro Camera series of Mitsubishi Paper Mills, Ltd.

The photosensitive material and/or the complexing agent sheet of the present invention may have conductive exothermic layers as heating means for heat development and diffusion transfer of silver salts. In this case, exothermic elements described in JP-A-61-145544 can be utilized.

In the present invention, it is preferred that heating carried out in the presence of a trace amount of water to conduct development and transfer simultaneously as described in U.S. Pat. Nos. 4,704,345 and 4,740,445, JP-A-61-238056, etc. The heating temperature is preferably from 50° C. to 100° C.

As water for use in the present invention, any water may be used as long as it is generally used. Specifically, distilled water, tap water, well water, mineral water, etc. can be used. In heat developing equipment in which the photosensitive material and the complexing agent sheet of the present invention are used, water may be used in the disposable form, or repeatedly circulated. The latter case results in use of water containing components eluted from the photosensitive material. Further, equipment and water described in JP-A-63-144354, JP-A-63-144355, JP-A-62-38460, JP-A-3-210555, etc. may be used. Furthermore, water may contain a water-soluble low boiling solvent, a surfactant, an antifoggant, a complex forming compound with a slightly soluble metal salt, the reducing agent of the present invention, an antifungal agent or a microbicide.

These water can be given to the photosensitive material or the complexing agent sheet or both, but preferably given to the photosensitive material. For the amount thereof used, the weight of the water corresponding to the maximum swelled volume of the whole coated films or less is sufficient. Specifically, it is generally from 5 to 30 ml/m$^2$, and preferably from 10 to 20 ml/m$^2$.

As methods for giving the water, for example, methods described in JP-A-62-253159, page 5, JP-A-63-85544, etc. are preferably used. Further, solvents can be enclosed in microcapsules, or hydrated solvents can be previously contained in the photosensitive material or the complexing agent sheet or both.

The temperature of water to be given may be from 30° C. to 60° C. as described in the above JP-A-63-85544. In particular, in order to prevent bacteria in water from propagating, it is useful to keep the temperature of water at 45° C. or more.

Hydrophilic heat solvents which are solid at ordinary temperature and fusible at high temperatures can be contained in the photosensitive material and/or the complexing agent sheet. The solvents may be contained in any of the photosensitive silver halide emulsion layers, the intermediate layers and the protective layers of the photosensitive material, and any layers of the complexing agent sheet. Examples of the hydrophilic heat solvents include urea compounds, pyridine compounds, amides, sulfonamides, imides, alcohols, oximes and other heterocyclic compounds.

Heating methods in the development and/or transfer stage include methods of bringing the photosensitive material and the complexing agent sheet into contact with heated blocks, heated plates, hot pressers, heat rolls, heat drums, halogen lamp heaters, infrared or far infrared lamp heaters, etc., and methods of passing them through atmospheres of high temperatures.

As a method for laminating the photosensitive material and the complexing agent sheet, methods described in JP-A-62-253159 and JP-A-61-147244 (corresponding to U.S. H691), page 27 can be applied.

Any of various heat development devices can be used for processing the photographic elements of the present invention. For example, devices described in JP-A-59-75247, JP-A-59-177547, JP-A-59-181353, JP-A-60-18951, JP-A-U-62-25994 (the term "JP-A-U" as used herein means an "unexamined published Japanese utility model application"), JP-A-6-130509, JP-A-6-95338, JP-A-6-95267, etc. are preferably used. As commercially available devices, Pictrostat 100, Pictrostat 200, Pictrostat 300, Pictrography 3000 and Pictrography 2000 manufactured by Fuji Photo Film Co., Ltd can be used.

The speed (linear speed) at which films are conveyed on these heat development devices may be slow or fast. If the size of the devices is intended to be miniaturized, the linear speed may be decreased, for example, to 200 mm/minute or less, and if it is intended to process a large amount of films for a short period of time, the linear speed may be increased, for example, to 1000 mm/minute or more, and further to 1500 mm/minute or more. Needless to say, a linear speed intermediate between these may be used according to the purpose.

The present invention will be described in more detail with reference to the following Examples, but the invention should not be construed as being limited thereto.

EXAMPLE 1

A method for preparing a photosensitive silver halide emulsion is described.

An aqueous solution of gelatin having a pH of 3 which was well stirred and had the composition shown in Table 1 was prepared at 40° C., and thereafter, the temperature was lowered to 37° C. Then, solution (I) and solution (II) shown in Table 2 were added thereto at the same time over 10 minutes, and 2 minutes after that, solution (III) and solution (IV) were added thereto at the same time for 19 minutes.

TABLE 1

| Composition of Aqueous Solution of Gelatin (pH 3) | |
|---|---|
| $H_2O$ | 650 cc |
| Lime-Treated Gelatin | 10 g |
| NaCl | 2.1 g |
| Solvent for Silver Halide (1) | 0.007 g |
| Citric Acid | 0.45 g |
| Sodium Benzenethiosulfonate | 0.006 g |
| Sodium Benzenethiosulfinate | 0.001 g |
| Temperature | 40° C. |

Solvent for Silver Halide (1)

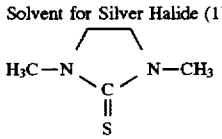

TABLE 2

| | Solution (I) | Solution (II) | Solution (III) | Solution (IV) |
|---|---|---|---|---|
| $AgNO_3$ | 37.5 g | | 62.5 g | |
| NaCl | | 12.75 g | | 21.0 g |
| KBr | | 0.45 g | | 0.75 g |

TABLE 2-continued

| | Solution (I) | Solution (II) | Solution (III) | Solution (IV) |
|---|---|---|---|---|
| Potassium Hexachloroiridate | | | | 350 μg |
| $(NH_4)_2RhCl_5(H_2O)$ | | 90 μg | | |
| Citric Acid | | 50 mg | | 50 mg |
| Total Amount | Water to make 120 ml | Water to make 120 ml | Water to make 200 ml | Water to make 200 ml |

After washing and salt removal (conducted by using precipitant (1) and adjusting to pH 3 with sulfuric acid) by the conventional method, 22 g of lime-treated gelatin was added thereto. After adjustment to pH 5.7 and pAg 7.8, chemical sensitization was performed at 60° C. Compounds used in chemical sensitization were added in turn as shown in Table 3. As to the time of addition, preservative (1), potassium bromide, sodium chloride and the decomposed product of ribonucleic acid were added at the same time after dispersing gelatin, and 2 minutes after that, the thiosulfonate and the sulfinate were added. Then, 2 minutes after that, sodium thiosulfate was added, and 3 minutes after that, chloroauric acid was added, followed by ripening for 64 minutes. Then, tetraazaindene was added to terminate chemical sensitization, and 2 minutes after that, the temperature was lowered thereby allowing the resulting emulsion to undergo gelation. The resulting silver chlorobromide emulsion had a silver bromide content of 1.7 mol %. The form of the grains was cubic, the average side length was 0.21 μm, and the standard deviation was 0.019 μm. The yield of this emulsion was 630 g.

Precipitant (1)

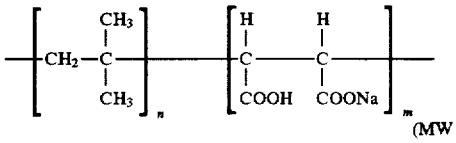

(MW = ca. 85,000)

Preservative (1)

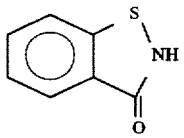

TABLE 3 pH 5.7, pAg 7.4

| Compounds Used in Chemical Sensitization | Amount Added |
|---|---|
| Preservative (1) | 50 mg |
| Sodium Chloride | 0.25 g |
| Potassium Bromide | 0.1 g |
| Decomposed Product of Ribonucleic Acid | 0.068 g |
| Sodium Benzenethiosulfinate | 71 mg |
| Sodium Benzenethiosulfonate | 18 mg |
| Sodium Thiosulfate Pentahydrate | 1.5 mg |
| Chloroauric Acid | 6.1 mg |
| 4-Hydroxy-6-methyl-1,3,3a,7-tetraazaindene | 20 mg |

Then, a method for preparing a dispersion of a reducing agent, 5-diphenyl-3-pyrazolidone (I-1), is described below.

Ten grams of 1,5-diphenyl-3-pyrazolidone and 0.1 g of Demol manufactured by Kao Corp. were added to 90 ml of a 5.7% aqueous solution of lime-treated gelatin, and dispersed in a mill using glass beads having a mean grain size of 0.75 mm, for 30 minutes. The glass beads were separated to obtain a gelatin dispersion of the reducing agent.

A solid dispersion of antihalation dye (1) was prepared also according to a method based on this method. A gelatin dispersion was obtained.

Antihalation Dye (1)

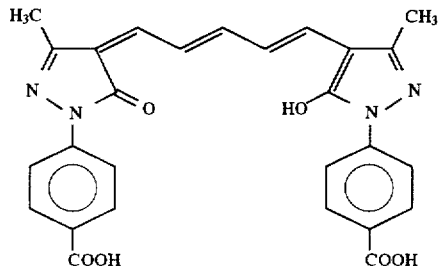

Then, a method for preparing a dispersion of zinc hydroxide is described below.

To 100 ml of a 4% aqueous solution of gelatin, 12.5 g of zinc hydroxide having a mean grain size of 0.08 μm, 1 g of carboxymethyl cellulose as a dispersing agent, and 0.1 g of polysodium acrylate were added, and dispersed in a mill using glass beads having mean grain size of 0.75 mm, for 30 minutes. The glass beads were separated to obtain a gelatin dispersion of zinc hydroxide.

Using the above, photosensitive material (A) shown in Table 4 was prepared. Polymer (1) is a copolymer of methyl methacrylate-styrene-2-ethylhexyl acrylate-methacrylic acid.

TABLE 4

CONSTITUTION OF Photosensitive material (A)

| Layer Name | Additives | Amount Coated (mg/m²) |
|---|---|---|
| 4th Layer (Protective Layer II) | Acid-Treated Gelatin | 172 |
| | PMMA Latex (3 μm in size) | 12 |
| | Sumikagel L-5H (manufactured by Sumitomo Chemical) | 64 |
| | Calcium Nitrate | 3 |
| | Surfactant (1) | 1 |
| | Surfactant (2) | 5 |
| 3rd Layer (Emulsion Layer) | Photosensitive Silver Halide Emulsion | 1430 (as silver) |
| | Sensitizing Dye (1) | 5 |
| | Sensitizing Dye (2) | 2 |
| | Compound (1) | 2 |
| | Compound (2) | 8 |
| | Surfactant (2) | 24 |
| | Water-Soluble Polymer (1) | 23 |
| 2nd Layer (Intermediate Layer) | 1,5-Diphenyl-3-pyrazolidone (I-1) | 1657 |
| | Lime-Treated Gelatin | 828 |
| | Dextran | 62 |
| | Hardener (1) | 35 |
| | Surfactant (2) | 7 |
| | Water-Soluble Polymer (1) | 10 |
| 1st Layer (Antihalation Layer) | Lime-Treated Gelatin | 660 |
| | Antihalation Dye (1) | 150 |
| | Zinc Hydroxide | 900 |
| | Zinc Thiosalicylate | 36 |
| | Surfactant (2) | 22 |

TABLE 4-continued

CONSTITUTION OF Photosensitive material (A)

| Layer Name | Additives | Amount Coated (mg/m²) |
|---|---|---|
| | Water-Soluble Polymer (1) | 35 |
| Support: Polyethylene Terephthalate (having a gelatin undercoat and a thickness of 100 μm) | | |
| 1st Backcoat Layer (Conductive Layer) | Lime-Treated Gelatin | 60 |
| | SN-38 (manufactured by Ishihara Sangyo) | 180 |
| 2nd Backcoat Layer (Gelatin Layer) | Lime-Treated Gelatin | 2000 |
| | Surfactant (3) | 7 |
| | Hardener (2) | 30 |
| | PMMA Latex (6 μm in size) | 49 |
| 3rd Backcoat Layer (Polymer Layer) | Polymer (1) | 1000 |

Sensitizing Dye (1)

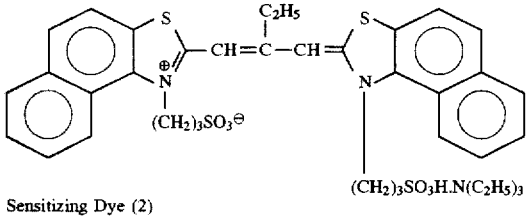

Sensitizing Dye (2)

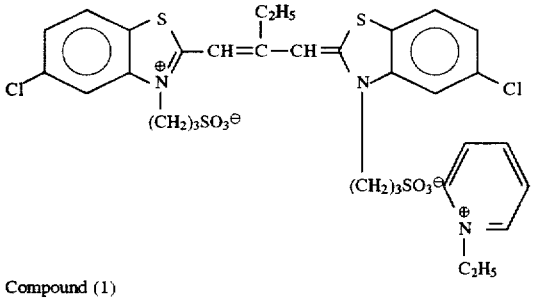

Compound (1)

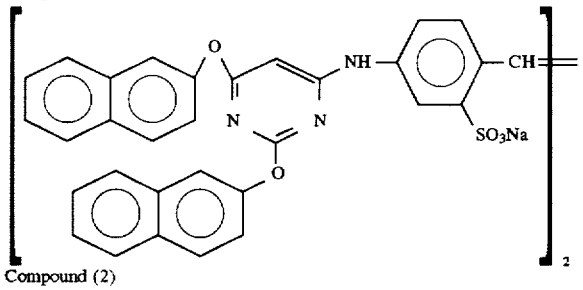

Compound (2)

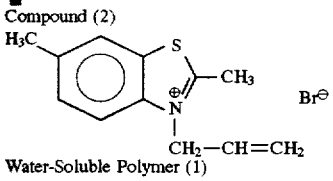

Water-Soluble Polymer (1)

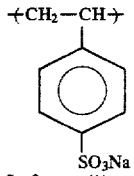

Surfactant (1)

$C_8F_{17}SO_2N(C_3H_7)CH_2COOK$

TABLE 4-continued

CONSTITUTION OF Photosensitive material (A)

| Layer Name | Additives | Amount Coated ($mg/m^2$) |
|---|---|---|
| | Surfactant (2) $NaO_3S-CH(CH_2COOCH_2CH(C_2H_5)C_4H_9)-COOCH_2CH(C_2H_5)C_4H_9$ | |
| | Surfactant (3) $C_{11}H_{23}CONHCH_2CH_2CH_2N^{\oplus}(CH_3)_2-COO^{\ominus}$ | |
| | Hardener (1) $CH_2=CHSO_2CH_2SO_2CH=CH_2$ | |
| | Hardener (2) $(CH_2)_2-(O-CH_2-CH(O)-CH_2)_2$ | |

Then, complexing agent sheet R1 as shown in Table 5 was prepared. A gelatin dispersion of high boiling organic solvent (1) (tricresyl phosphate) was used. Polymer (2) (mordant) is polyvinyl-N-imidazole.

TABLE 5

CONSTITUTION OF COMPLEXING AGENT SHEET R1

| Layer Name | Additives | Amount Coated ($mg/m^2$) |
|---|---|---|
| 4th Layer (Protective Layer) | K Carrageenan | 58 |
| | Sumikagel L-5H (manufactured by Sumitomo Chemical) | 164 |
| | Lime-Treated Gelatin | 32 |
| | Surfactant (1) | 8 |
| | Surfactant (2) | 7 |
| | Surfactant (3) | 61 |
| | Colloidal Silver (0.04 μm) | 12 |
| | Potassium Nitrate | 82 |
| | 3.6 μm Silica | 9 |
| 3rd Layer (Intermediate Layer) | Lime-Treated Gelatin | 245 |
| | Sumikagel L-5H (manufactured by Sumitomo Chemical) | 26 |
| | Surfactant (2) | 9 |
| | Hardener (2) | 182 |
| 2nd Layer (Complexing Agent Layer) | Lime-Treated Gelatin | 2422 |
| | High Boiling Organic Solvent (1) | 2000 |
| | Dextran | 620 |
| | Polymer (2) | 2280 |
| | Guanidine Picolinate | 2700 |
| | Quinolinates (molar ratio of potassium/sodium: 1:1) | 270 |
| | Hydantoin (added as a potassium hydroxide solution) | 560 |
| | Surfactant (2) | 22 |
| 1st Layer (Intermediate Layer) | Lime-treated Gelatin | 185 |
| | Sumikagel L-5H (manufactured by Sumitomo Chemical) | 8 |
| | Surfactant (2) | 9 |
| | Hardener (2) | 182 |

Support: Polyethylene Terephthalate (having a gelatin undercoat and a thickness of 60 μm)

Then, reducing agents were each added to the third layer (emulsion layer) and the second layer (intermediate layer) of photosensitive material (A) as shown in Table 6 to prepare photosensitive materials (B) to (I).

Photosensitive materials (A) to (I) obtained as described above were exposed, changing the quantity of light at a ten millionth of a second per one picture element (100 $\mu m^2$) by use of a semiconductor laser having a peak at 680 nm. Each photosensitive material exposed was immersed in water maintained at 40° C. for 2.5 seconds, followed by squeezing with rolls, and immediately, the complexing agent sheet was placed thereon so that a film surface thereof came into contact with the complexing agent sheet. Subsequently, each photosensitive material was heated for 15 seconds by use of a heat drum adjusted to such a temperature that the temperature of the water-absorbed film surface was elevated to 80° C. When the complexing agent sheet was peeled off, a black-and-white image was obtained on the photosensitive material.

A characteristic curve showing the relationship between a blue density of a transmitted image and an exposure amount was obtained by use of an automatic densitometer. From this characteristic curve, the maximum density (Dmax) and the minimum density (Dmin) were measured.

The halftone image quality is evaluated in accordance with the following criteria:

A: very good;

B: good; and

C: slightly poor, but applicable.

Results thereof are shown in Table 6 (Table 6-1 and Table 6-2).

TABLE 6-1

| Photographic Material | Reducing Agent of Third Layer (Amount Added) ($mg/m^2$) | Reducing Agent of Second Layer (Amount Added) ($mg/m^2$) | Molar Ratio of 1-Phenyl-3-pyrazolidone Compound to Dihydroxybenzene Compound |
|---|---|---|---|
| (A) | — | Reducing Agent (I-1) of the Invention (1657) | 100:0 |
| (B) | Reducing Agent (III-2) of the Invention (245) | ditto | 82:18 |
| (C) | Reducing Agent (II-6) of the Invention (213) | ditto | 82:18 |
| (D) | Reducing Agent (III-10) of the Invention (550) | Reducing Agent (I-1) of the Invention (1326) | 65:35 |
| (E) | Reducing Agent (I-1) of the Invention (332) | Reducing Agent (I-1) of the Invention (1657) | 100:0 |
| (F) | — | Reducing Agent (I-1) of the Invention (1326) Reducing Agent (III-2) of the Invention (490) | 65:35 |
| (G) | Reducing Agent (III-7) of the Invention (223) | Reducing Agent (I-8) of the Invention (1368) | 90:10 |
| (H) | Reducing Agent (I-1) of the Invention (332) | Reducing Agent (II-2) of the Invention (1156) | 17:83 |
| (I) | 4-n-Hexadecyl catechol (inorganic value/organic value = 215/440) (493) | Reducing Agent (I-1) of the Invention (1657) | 82:18 |

TABLE 6-2

| Photographic Material | Dmax | Dmin | Halftone Image Quality | Remarks |
|---|---|---|---|---|
| (A) | 3.22 | 0.21 | C | Comparison |
| (B) | 3.86 | 0.15 | A | Invention |

TABLE 6-2-continued

| Photographic Material | Dmax | Dmin | Halftone Image Quality | Remarks |
|---|---|---|---|---|
| (C) | 3.55 | 0.15 | A | Invention |
| (D) | 3.61 | 0.16 | A | Invention |
| (E) | 3.24 | 0.20 | C | Comparison |
| (F) | 3.76 | 0.16 | A | Invention |
| (G) | 3.70 | 0.14 | A | Invention |
| (H) | 3.34 | 0.28 | B | Invention |
| (I) | 3.01 | 0.29 | C | Comparison |

In the above table, (A), (E) and (I) are comparative examples, and (B), (C), (D), (F), (G) and (H) are examples of the invention. The density is the visual density.

From Table 6, photosensitive materials (A) and (E) in which only the 1-phenyl-3-pyrazolidone compound was used as the reducing agent scarcely exhibited improvement with respect to all of Dmax, Dmin and the halftone image quality, even if the addition amount of the reducing agent was increased. In contrast, the results revealed that photosensitive materials (B), (C), (D), (F) and (G) in which the dihydroxybenzene compound was used in combination with the 1-phenyl-3-pyrazolidone compound exhibited improvement with respect to all of Dmax, Dmin and the halftone image quality.

Further, photosensitive material (H) in which the coated amount (molar amount) of the dihydroxybenzene compound was more than the coated amount (molar amount) of the 1-phenyl-3-pyrazolidone compound (pyrazolidone compound: dihydroxybenzene compound=17:83 (molar ratio)) exhibited increase in Dmin. In photosensitive material (H) after processing, yellowish brown stains were observed, and when it was printed on a presensitized plate using a mercury lamp, increase in exposure time was brought about. Furthermore, photosensitive material (I) in which 4-n-hexadecylcatechol having an organic value of more than 400 was used as a reducing agent was lowered in Dmax, and was not improved in the halftone image quality. In photosensitive material (I) after processing, yellowish brown stains were also observed.

It was found that the combinations of the reducing agents according to the present invention provide a low Dmax, a high Dmin and good halftone dots.

According to the present invention, the image forming method is provided in which silver images low in fog and high in density are obtained in a short period of time, and further, good halftone images are obtained with high contrast.

What is claimed is:

1. An image forming method comprising the steps of:

(a) superposing a heat development photosensitive material on a sheet after or simultaneously with imagewise exposing the heat development photosensitive material, wherein the photosensitive material comprises a support having thereon at least a photosensitive silver halide, a hydrophilic binder and a slightly water-soluble basic metal compound, and the sheet comprises a support having thereon at least a compound which forms a complex with the metal ion constituting the basic metal compound, a solvent for a silver halide and a physical development nucleus; and (b) heat developing the laminate in the presence of a reducing agent and water to form an image or either or both of the photosensitive material and the sheet, wherein the reducing agent comprises a 1-phenyl-3-pyrazolidone compound and a dihydroxybenzene compound having an inorganic value of not less than 215 and an organic value of from 120 to 400, and the molar ratio of the 1-phenyl-3-pyrazolidone compound to the dihydroxybenzene compound is from 60:40 to 95:5.

2. The image forming method according to claim 1, wherein the dihydroxybenzene compound is a catechol compound.

3. The image forming method according to claim 1, wherein the sheet further comprises a mordant, and an image is formed on the photosensitive material.

* * * * *